US006793253B2

(12) United States Patent
Bruwer et al.

(10) Patent No.: US 6,793,253 B2
(45) Date of Patent: Sep. 21, 2004

(54) LOCK

(75) Inventors: Frederick Johannes Bruwer, Paarl (ZA); Aucamp Brandt, Paarl (ZA); Lajos Monte Vari, Pretoria (ZA)

(73) Assignee: Azotec (PTY) Ltd., Paarl (ZA)

( * ) Notice: Subject to any disclaimer, the term of this patent is extended or adjusted under 35 U.S.C. 154(b) by 31 days.

(21) Appl. No.: 10/182,055

(22) PCT Filed: Mar. 23, 2001

(86) PCT No.: PCT/ZA01/00034

§ 371 (c)(1),
(2), (4) Date: Jul. 25, 2002

(87) PCT Pub. No.: WO01/71131

PCT Pub. Date: Sep. 27, 2001

(65) Prior Publication Data

US 2003/0062728 A1 Apr. 3, 2003

(30) Foreign Application Priority Data

| | | |
|---|---|---|
| Mar. 24, 2000 | (ZA) | 2000/1482 |
| Jun. 21, 2000 | (ZA) | 2000/3107 |
| Jan. 11, 2001 | (ZA) | 2000/0302 |

(51) Int. Cl.[7] ..... E05C 1/06
(52) U.S. Cl. ..... 292/144; 292/169.15
(58) Field of Search ..... 70/277, 280, 282; 292/144, 169, 169.13, 169.14, 169.15

(56) References Cited

U.S. PATENT DOCUMENTS

| | | | | |
|---|---|---|---|---|
| 2,638,772 A | | 5/1953 | Ramler | |
| 4,073,527 A | | 2/1978 | Schlage | |
| 4,677,834 A | * | 7/1987 | Hicks | 70/279 |
| 4,854,619 A | | 8/1989 | Nakauchi | |
| 4,929,003 A | * | 5/1990 | Mcconnell | 292/144 |
| 4,995,248 A | | 2/1991 | Liu | |
| 5,681,070 A | | 10/1997 | Williams et al. | |
| 5,876,073 A | * | 3/1999 | Geringer | 292/144 |
| 5,878,612 A | * | 3/1999 | Mauer | 70/279 |
| 5,943,888 A | * | 8/1999 | Lawson | 70/278 |
| 6,112,563 A | * | 9/2000 | Ramos | 70/278.1 |
| 6,354,121 B1 | * | 3/2002 | Frolov | 70/277 |

FOREIGN PATENT DOCUMENTS

EP 0 670 404 9/1995

* cited by examiner

*Primary Examiner*—Gary Estremsky
(74) *Attorney, Agent, or Firm*—Young & Thompson

(57) ABSTRACT

A lock which includes a bolt, a catch, a handle for manually moving the catch from an operative position to an inoperative position, first link means, and electrically actuable means for causing movement of the first link means between first and second positions, the first link means, at the said first position, translating movement of the handle in a first direction into movement of the bolt from a locked position to an unlocked position and, at the said second position, allowing handle movement in the said first direction without corresponding movement of the bolt.

11 Claims, 29 Drawing Sheets

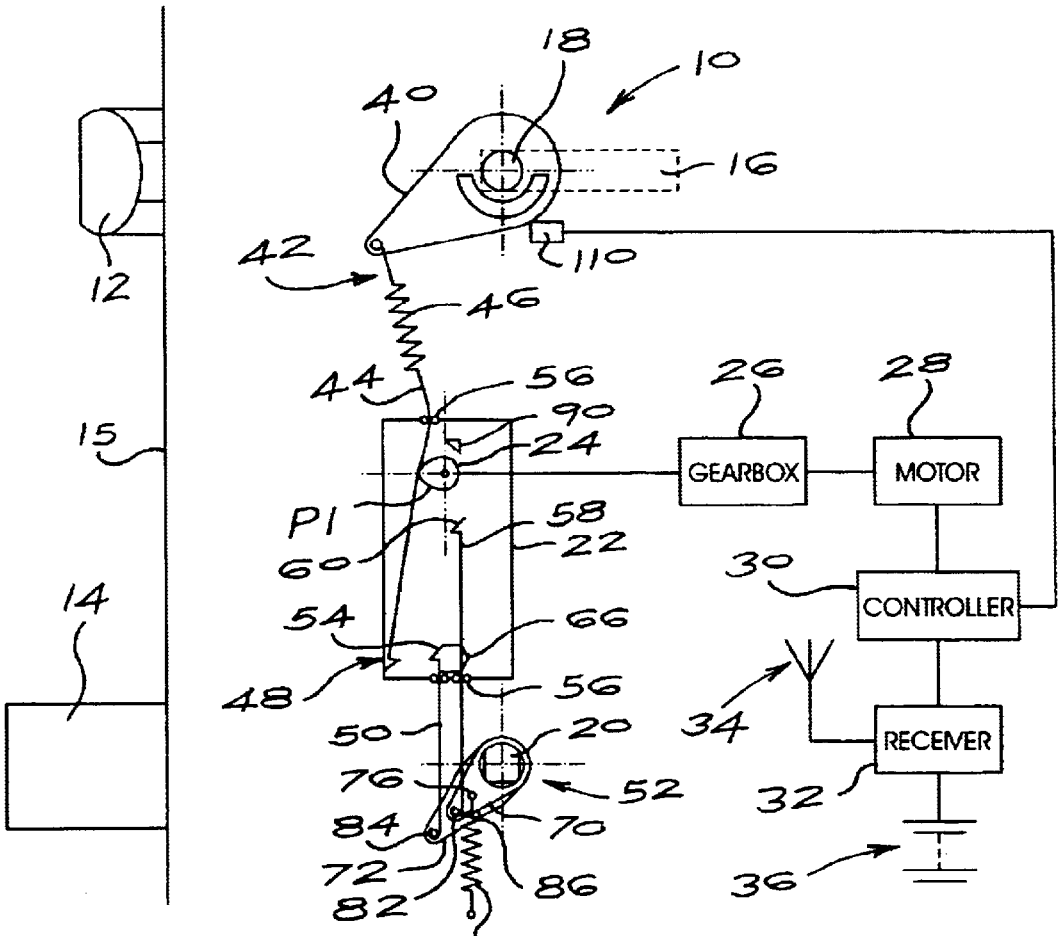
FIG 7a
FIG 7
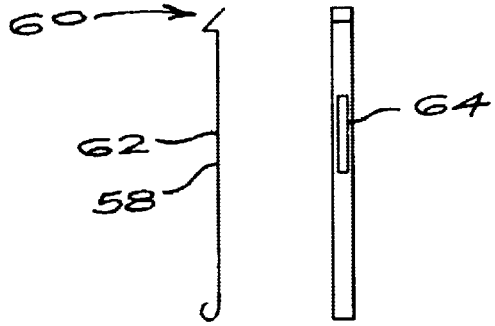
FIG 8

LOCK

BACKGROUND OF THE INVENTION

This invention relates to a lock of the type which includes a bolt and a catch.

A lock of the aforementioned kind is, in general terms, in widespread use. Normally the bolt and the catch are within separate enclosures although this is not necessarily the case. The bolt is operable by means of a key, on an outer side of the door, and a short twist lever or a key on an inner side of the door. The bolt, when moved by the key or the lever, is moved to a retracted position to unlock the door.

The catch is movable by means of handles on the inner and outer sides of the door respectively. The outer handle is lockable with a key and the inner handle is lockable with a twist lever or a key. If either handle is locked then the handles cannot be turned to operate the catch. Normally the catch has a memory, in the nature of a restoring spring, and is moved to its original position once either handle is released.

It is known to modify or adapt a lock of the aforementioned kind so that at least some of its functions can be controlled by means of remotely transmitted signal eg. a radio or similar signal. By way of example a remotely transmitted signal can be used to lock the bolt or unlock the bolt. International application No. PCT/ZA99/00116 describes a lock which stores energy when the bolt is moved manually to an unlocked position. When a correctly encoded remotely transmitted signal is received by a receiver associated with the lock the energy is released and is used to move the bolt to the locked position. The construction is such however that the bolt can be moved from the unlocked to the locked position, and vice versa, by means of a key.

EP 670404 discloses a lock which includes a bolt, a catch, a handle for manually moving the catch from an operative position to an inoperative position, first link means, and electrically actuable means for causing movement of the first link means between first and second positions, the first link means, at the first position, translating movement of the handle in a first direction into movement of the bolt from a locked position to an unlocked position and, at the second position, allowing movement in the first direction without causing corresponding movement of the bolt. The document does not however disclose any manner in which the locking action of the lock can be electrically controlled.

SUMMARY OF THE INVENTION

The invention is concerned with a lock of the aforementioned kind which lends itself to being actuated at least partly by electronic means.

A lock which includes a bolt, a catch and a handle for manually moving the catch from an operative position to an inoperative position, first link means, electrically actuable means for causing movement of the first link means between first and second positions, the first link means, at the first position, translating movement of the handle in a first direction into movement of the bolt from a locked position to an unlocked position and, at the second position, allowing handle movement in the first direction without corresponding movement of the bolt and energy storage means which is operable to release energy which at least assists in moving the bolt from the unlocked position to the locked position, and which is characterized in that the lock includes a catch mechanism for retaining the bolt in the unlocked position and wherein the electrically actuable means is operable to release the catch mechanism to allow the bolt to be moved from the unlocked position to the locked position under the action of the energy storage means.

The lock may include an axle, a hold lever, which is rotatable about the axle, an unlock lever which is fixed to, and which is rotatable in unison with, the axle, and at least one formation on at least one of the hold lever and the unlock lever whereby rotation of the hold lever in a first direction causes rotation of the unlock lever in the first direction, rotation of the hold lever in a second direction which is opposite to the first direction does not cause corresponding rotation of the unlock lever in the second direction, rotation of the unlock lever in the second direction causes corresponding rotation of the hold lever in the second direction, and rotation of the unlock lever in the first direction does not cause corresponding rotation of the hold lever in the first direction, a component of the first link means being connected to the hold lever and a component of the catch mechanism being connected to the unlock lever, whereby movement of the first link component caused by movement of the hold lever in the second direction causes movement of the catch mechanism component from a retaining position to a non-retaining position.

The said electrically actuable means may be operable to cause movement of the component of the catch mechanism from the said retaining position to the said non-retaining position.

The lock may include a receiver and decoder which receive an externally generated signal from any appropriate source such as a card reader, keypad, any suitable recognition device, a radio transmitter, or the like. The scope of the invention is not limited in this regard. If a correctly encoded signal or a valid signal is received then the retaining means may be moved in the manner described.

Communication with the lock may be uni-directional, or bi-directional e.g. in a "challenge-response" routine or mode. In each case a signal may be transmitted, by a direct link or a a wireless link, from a source which is close to a lock, or from a remote source e.g. a central control unit. The signal could simultaneously actuate a number of locks. A phone link, an Internet connection. Bluetooth, or any similar device or arrangement could be used to address the lock directly or through the medium of a control unit. The lock may be capable of reporting or responding, e.g. to a control unit or any actuating source, through any appropriate medium, directly or through a wireless. Internet or other link. The lock may for example report to an alarm system to indicate that a door is open or closed or possibly, that the door has been forced open.

Where a plurality of locks are used, a central system or an alarm system may be installed that can individually or collectively instruct the locks to lock and unlock. The locks may report to the central system indicating information such as whether they have been successfully locked, and whether the respective doors are open or closed. The central system may also communicate with other systems which may include garage doors to lock and unlock such doors and to check on their status such as open or closed. The central system may be interfaced by a user directly or may be communicated with by the user via a telephone link, the Internet or a satellite. This communication may take place via a variety of mediums, such as wired, radio frequency and infrared links.

Single hand-held controllers may be used to lock a variety of locks with one button press, or single locks with the press of another button, or a code of button presses. For certain buttons of the hand-held controller, the power that is emitted may be higher than for other buttons of the same hand-held controller. This makes it possible to limit the working range of some of the buttons on the hand-held controller and helps to prevent the accidental locking and unlocking of surrounding locks if a specific lock is to be locked and unlocked, if a hand-held controller can lock and unlock more than one lock. For hand-held controllers communication can take place via a variety of mediums, such as radio frequency and infrared links.

It is also possible to actuate the lock by means of any appropriate device, e.g. a push button which is installed at a convenient and safe location and which may be linked directly to the lock.

It is possible to implement the principles of the invention on a retro-fit basis in that a kit can be provided to adapt existing installed locks to function in the manner which is described herein. Obviously it is also possible to provide a custom-designed assembly of components which make up a lock according to the invention, for new installations.

It has however been found with a lock of the aforementioned type, particularly if the lock is not satisfactorily installed in a door, that it is possible to retract the bolt and the catch from keeps or retaining formations in a door frame with the bolt not being retained in a fully retracted position. Under these conditions, with the door open, if the actuating handle is released the bolt will automatically move to an extended position, to which it is normally biased by means of a spring, and this will prevent the door from being closed for the bolt will strike against the door frame.

Another factor is that it is desirable, from the point of view of enhancing the security afforded by the lock, to be able to place the lock in a disabled mode in which it cannot be unlocked manually and, preferably, to be able to place the lock in this mode using electronic means.

These optional objectives may be achieved by designing the lock, so that the said movement of the catch from the operative position to the inoperative position is linear movement the said movement of the bolt from the locked position to the unlocked position is linear movement, and so that the said linear movement of the bolt is greater than the said linear movement of the catch.

With this second embodiment of the invention the said handle may be mounted to a catch axle and the first link means may include a catch lever which is mounted for rotation to the catch axle a bolt lever which is mounted for rotation to a bolt axle and a link which extend between a pivot point on the catch lever and a pivot point on the bolt lever. To enable the linear movement of the bolt to be greater at least initially, than the linear movement of the catch the distance between the pivot point on the catch lever and the catch axle may be greater than the distance between the pivot point on the bolt lever and the bolt axle. It is also necessary to chose the starting angles of the catch and bolt levers with care. Clearly though any other suitable technique could be employed to achieve this effect.

In order to place the lock in a key disable mode the lock may include a key disable lever and actuating means for causing movement of the key disable lever from a position at which it allows unimpeded movement of the bolt lever to a position at which it prevents movement of the bolt lever. In another form of the invention the lock may be placed in a key disable mode by means of a mechanism which disengages the bolt axle from a key cylinder or any equivalent device. The key cylinder (or equivalent device) is then freely movable without having any effect on the bolt axle or bolt.

The actuating means may be of any suitable type and preferably includes a cam and electrical means for causing controlled movement of the cam.

These principles can be applied, in a more generalized way, by providing a lock which includes a bolt, a key actuated mechanism for moving the bolt between a locked position and an unlocked position, a blocking device, and a controller which, in response to at least one remotely transmitted signal, causes movement of the blocking device between a first position at which the key actuated mechanism is operable and a second position at which the blocking device prevents operation of the key actuated mechanism.

The bolt may thus be kept in a locked position ie. it cannot be unlocked by means of a key, or in an unlocked position ie it cannot be locked by means of a key, according to requirement.

The key actuated mechanism may be of any suitable kind and for example may include a cylinder lock, a lever lock, or any other appropriate type of lock which is known in the art.

The bolt may be slidable between the said locked and unlocked positions.

The blocking device may take on any appropriate form and for example may be in the nature of a member which is movable to prevent engagement of the key with the key actuated mechanism. Thus, for example, the blocking device may include a plate or other member which blocks a keyhole or key aperture thereby to prevent engagement of a key with the key actuated mechanism or, where appropriate, disengagement of the key from the key actuated mechanism.

It is also possible to allow a key to be engaged with the key actuated mechanism but to prevent the key from operating the key actuated mechanism.

The said remotely transmitted signal may be a radio signal a signal transmitted by means of a push button, an infrared signal or the like. The invention is not limited in this regard.

The controller may be of any appropriate type and for example may be of the general kind described in the specification of international application No PCT/ZA99/00116. Thus, for example the controller may act on a cam which causes movement of the blocking device. Drive to the cam may be imparted by means of an electrical motor which may, in turn, operate through the medium of a worm gear or similar reduction arrangement. Any other electromechanical mechanism, such as a solenoid or other mechanism such as a pneumatic air under may be used to achieve this movement of the blocking device.

BRIEF DESCRIPTION OF THE DRAWINGS

The invention is further described by way of examples with reference to the accompanying drawings in which:

FIG. 7 is a somewhat schematic side view of a lock according to a first form of the invention with a catch and a bolt in respective operative positions, FIG. 8 has two views, at 90° to each other respectively, of a catch mechanism which is used in the lock of FIG. 7.

DESCRIPTION OF PREFERRED EMBODIMENTS

Figure 1:
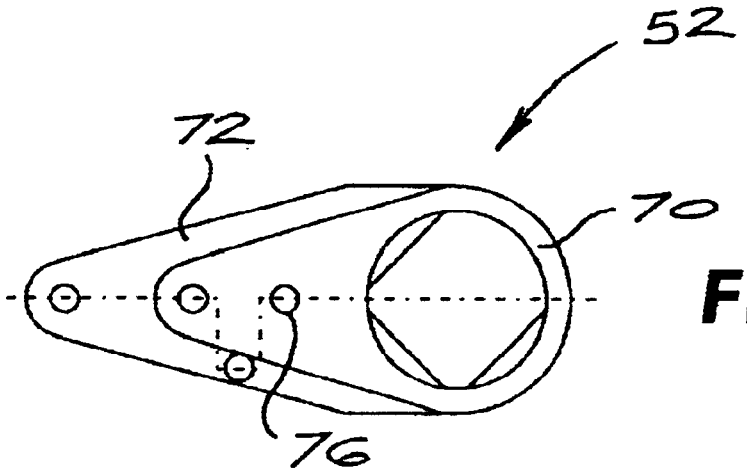
FIG. 1 is a side view of a lever mechanism used in a lock according to a first form of the invention.
Figure 2:
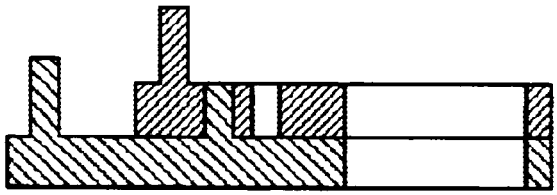
FIG. 2 is cross-sectional view at right angles to the view of FIG. 1 of the lever mechanism.
Figure 3:
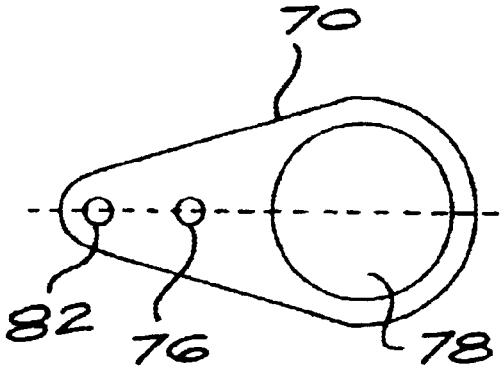
FIG. 3 is a side view of a hold lever used in the lever mechanism.
Figure 4:
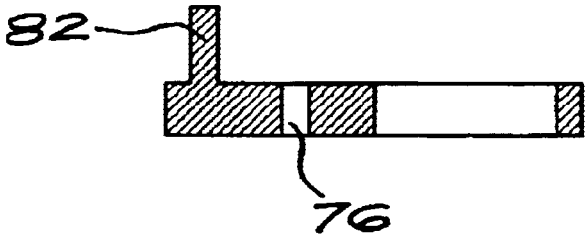
FIG. 4 is a cross-sectional view of the hold lever at right angles to the view of FIG. 3.
Figure 5:
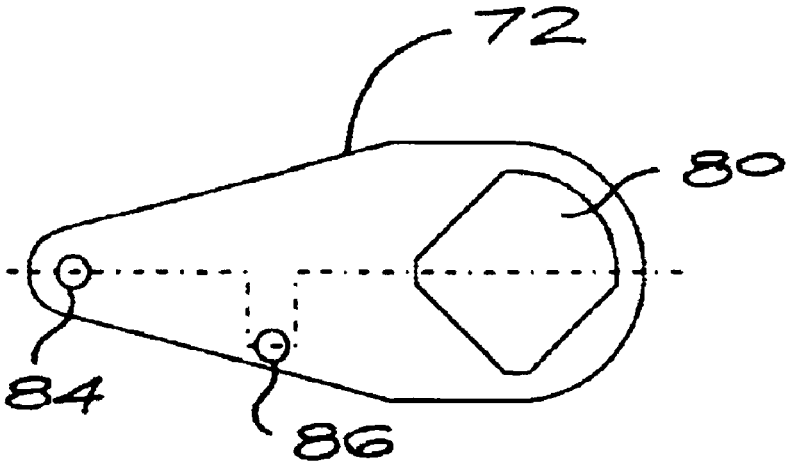
FIGS. 5 and 6 are views similar to FIGS. 3 and 4 respectively of an unlock lever.
Figure 6:
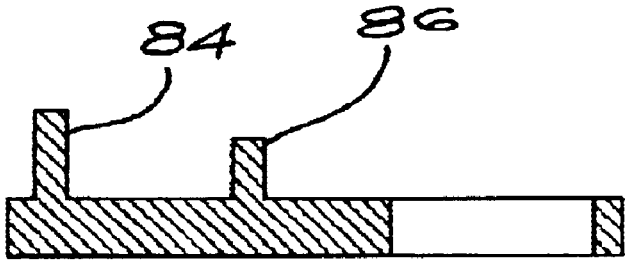

FIG. 7 illustrates from the side and somewhat schematically a lock 10 according to the invention which includes a catch 12 and a bolt 14 and which is mounted to a door 15. The catch is movable by means of a handle 16 which acts on an axle 18. The manner in which rotational movement of the axle 18 is translated into linear movement of the catch is known in the art and consequently is not further described herein.

Similarly the bolt 14 is linearly movable to and fro by rotational movement of a bolt axle 20. Again the way in which this movement is achieved is known in the art and consequently is not further described herein. Normally the bolt axle is rotatable from an outer side of the door, by means of a key which acts on a separate lock cylinder not shown while, from an inner side of the door, the bolt axle is rotatable by means of short twist lever, not shown. These aspects are however known in the art.

A mounting plate 22 is positioned between the axles 18 and 20. A cam 24 is mounted for rotational movement to the plate. As is shown in block diagram form in the inset drawing to FIG. 7 the cam 24 is movable by means of drive from a gearbox 26 which in turn is rotatable by means of an electric motor 28. The motor operates under the control of a control unit 30 which in turn is operated by means of signals output by a receiver 32. The receiver 32 has an antenna 34 which receives radio control signals from a remote control device which is normally hand held and which is not shown in the drawing. This kind of operation is common and is encountered for example in the remote opening of garage doors, gates and the like. An onboard battery 36 is used to power the receiver, the controller and the motor.

A catch lever 40 is connected to the axle 18. A first link arrangement 42 depends from the catch lever. The first link arrangement includes a flexible elongate link 44 with an in-line release spring 46. The link 44, at a lower end, has a hook formation 48.

A component 50 is fixed to a bolt lever mechanism 52 which, in turn, is attached to the bolt axle 20. The bolt lever mechanism is shown in FIGS. 1 to 6 and is further described hereinafter. The upper end of the component 50 has a hook formation 54 which is complementary to the hook formation 48 on the link 44.

The plate 22 has a number of spaced guide pins 56 and the link 44 and the component 50 pass between respective pairs of the guide pins.

A catch mechanism 58 extends upwardly from the bolt lever mechanism 52. It also passes between a pair of guide pins. At its upper end the catch mechanism has a hook formation 60.

The catch mechanism 58 is shown in two views, which are at right angles to one another in FIG. 8. The catch mechanism is formed from a slender flexible plate 62 which has a centrally located narrow slot 64. It is to be noted that the hook formation 54 which is at the upper end of the component 50 has a cam surface 66 which extends to the right of the component 50 and which is shaped to enter the slot 64. The cam surface is able to move with a limited degree of lost motion relatively to, and inside the slot 64.

The bolt lever mechanism 52 includes a hold lever 70 and an unlock lever 72 which are shown in further detail in FIGS. 1 to 6. A locking spring 74 acts on a formation 76 on the hold lever while an opposing side of the locking spring is attached to fixed structure, not shown The hold lever and the unlocked lever are mounted on the axle 20. As is evident from FIG. 8 the hold lever has a central round hole 78 which retains the lever on the axle but which permits relative rotation of the lever relatively to the axle. On the other hand the unlock lever 72 has a hole 80 which engages firmly with an outer surface of the bolt axle (see FIG. 5) and which ensures that the unlock lever and the axle are moved in unison.

The hold lever 70 has an outwardly extending pin 82 on an outer surface. The unlock lever has a pin 84 at its extremity and a pin 86 at an intermediate location. The pin 86 abuts a side surface of the hold lever. The component 53 is attached to the pin 84. The catch mechanism 58 which is shown in detail in FIG. 8 is attached to the pin 82.

The lock of the invention is designed to be used in a manual sense similar to the operation of a conventional lock and electrically. Consequently there are essentially four modes of operation namely, electronic unlocking; electronic locking; manual unlocking; and manual locking. Each mode of use is described hereinafter.

ELECTRONIC UNLOCKING

For normal electronic operation the unlocking process is started by a user signalling when he wants the door unlocked. It is assumed that the lock is in the position shown in FIG. 7 in which the catch and the bolt are respectively at locking positions. The cam 24 is in a position, designated P1, at which the cam deflects the link 44 to the left so that the hook formation 48 does not engage with the hook formation 54. Clearly, in the FIG. 7 position, the handle 16 can be rotated to cause retraction of the catch. The link 44 then moves up as the catch is retracted but as the hook formation 54 does not engage with the hook formation 48 there is no corresponding movement of the bolt 14.

Figure 9:
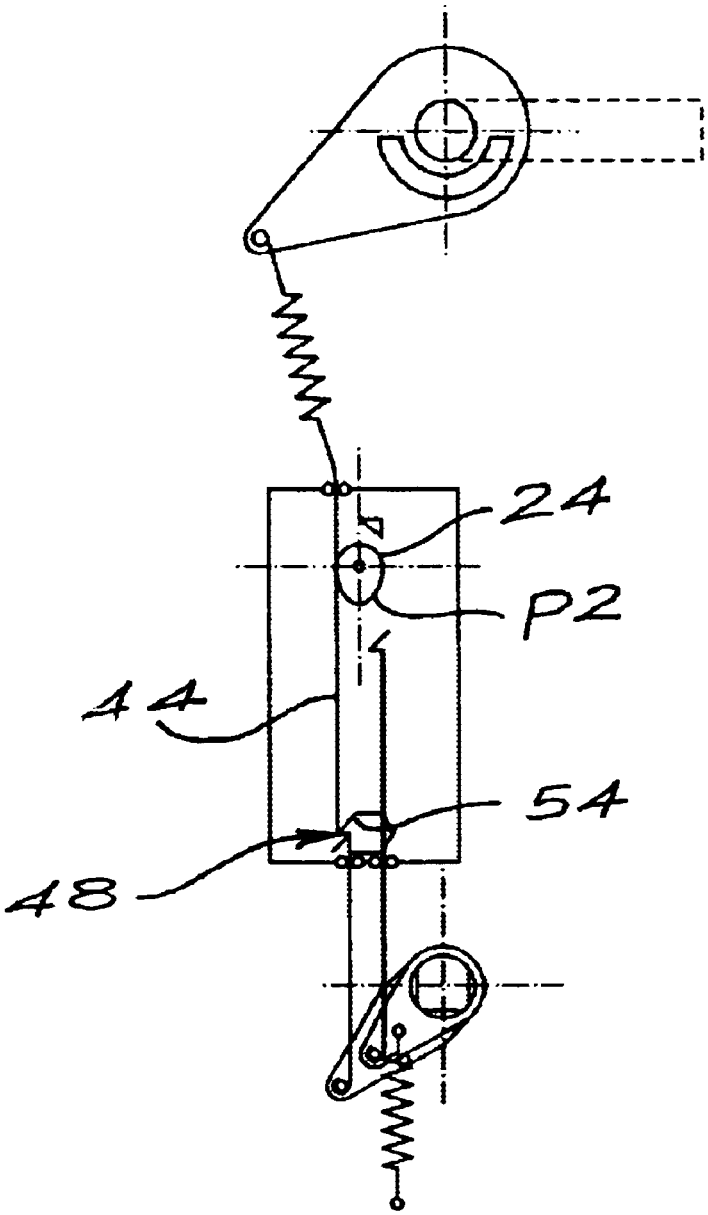
FIG. 9 shows the lock of FIG. 7 in a position at which movement of the catch causes movement of the bolt.

Assume that a user transmits a signal which is received by the receiver 32. This signal is decoded and, if correctly identified, is used via the controller 30 to operate the motor 28. The motor, through the gearbox 26, drives the cam 24 from the P1 position of FIG. 7 to the position shown in FIG. 9 which is referred to herein as the P2 position.

The cam, in the P2 position, does not deflect the link 44 which therefore moves under its own resilience inwardly to a position at which the hook formations 48 and 54 are interengaged.

Figures 10, 10A:
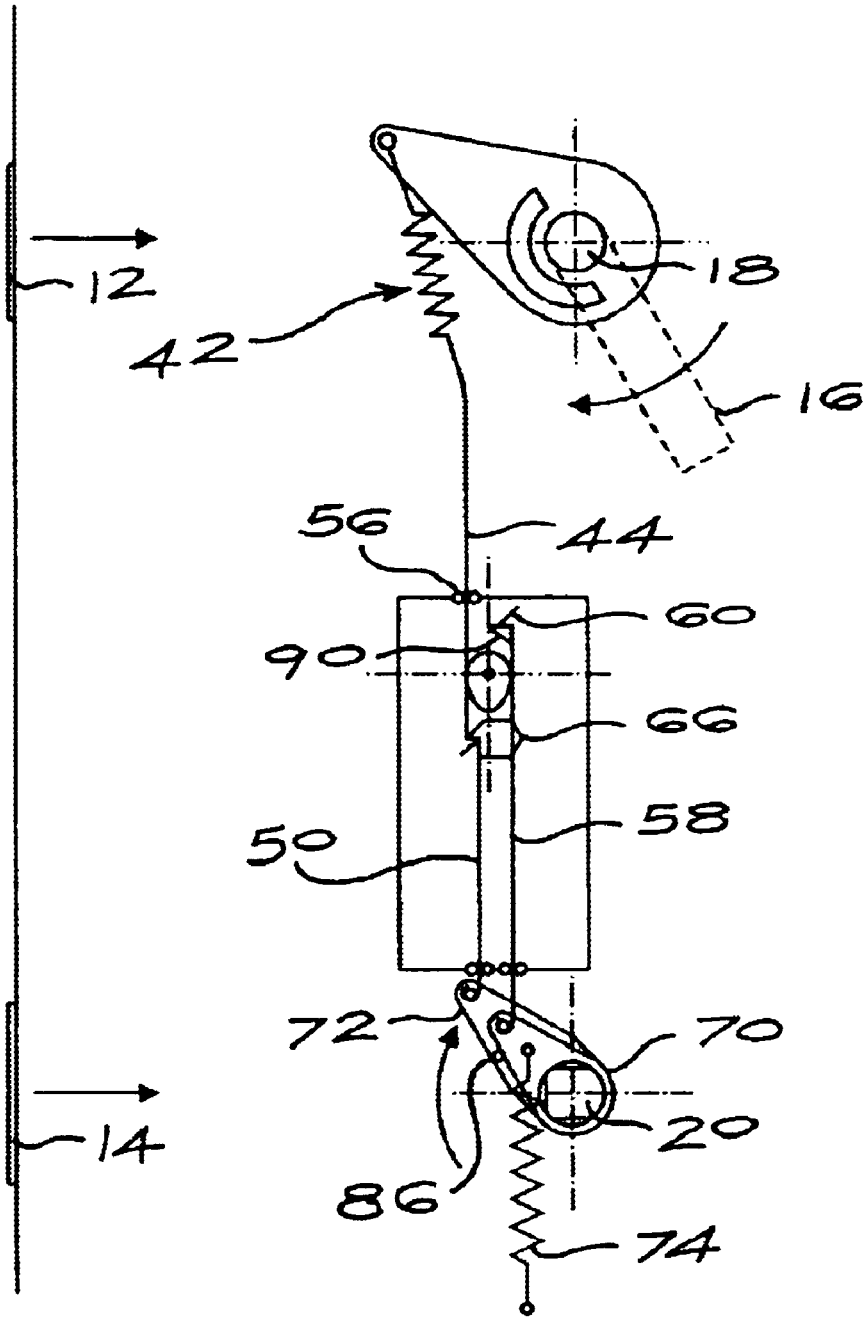
FIG. 10 shows the lock of FIG. 7 with the catch and the bolt retracted.

FIG. 10 illustrates the next sequence of operation. The handle 16 is rotated in a conventional sense and the linkage arrangement 42 is thereby raised, rotating with the axle 18. The link 44 is lifted, being guided through the pins 56, and the link component 50 is also lifted. The unlock lever is thereby rotated in a clockwise sense and, as the unlock lever is fixed to the bolt axle 20, the bolt axle is also rotated The pin 86 on the unlock lever causes corresponding rotation of the hold lever 70. The spring 74 is thereby extended.

As the mold lever 70 is rotated in a clockwise sense the catch mechanism 58 is lifted and is guided for movement through its corresponding guide pins. The retaining hook formation 60 at an upper end of the catch mechanism is shaped so that when it impacts a hold catch 90 on the plate it is first deflected to the right and then under the resilience of the catch mechanism, moves to the left to engage with an upper surface of the catch 90. During this movement to the extent necessary, the cam surface 66 of the component 50 moves inside the slot 64.

With the lock in the FIG. 10 position when the handle 16 is released the catch 12 moves from a retracted to an extended position without causing corresponding movement of the bolt 14. When the catch lever is moved from the position shown in FIG. 9 to the position shown in FIG. 10 and the bolt should for whatever reason become jammed then the release spring 42 is able to extend to relieve undue pressure on the other parts thereby reducing the likelihood that these parts will become damaged As is shown FIG. 11 after the handle 16 is released the handle returns to a neutral position with the catch extended A sensor 110 is used to sense the position of the catch lever and once the catch 12 has been extended, the sensor signals the control unit 30 which then causes movement of the cam from the P2 position to the P1 position. Thus, with the lock in the FIG. 11 position, the catch can be moved to and fro to latch or unlatch the door and the bolt remains in the retracted or unlocked position.

ELECTRONIC LOCKING

Figures 12, 12A:
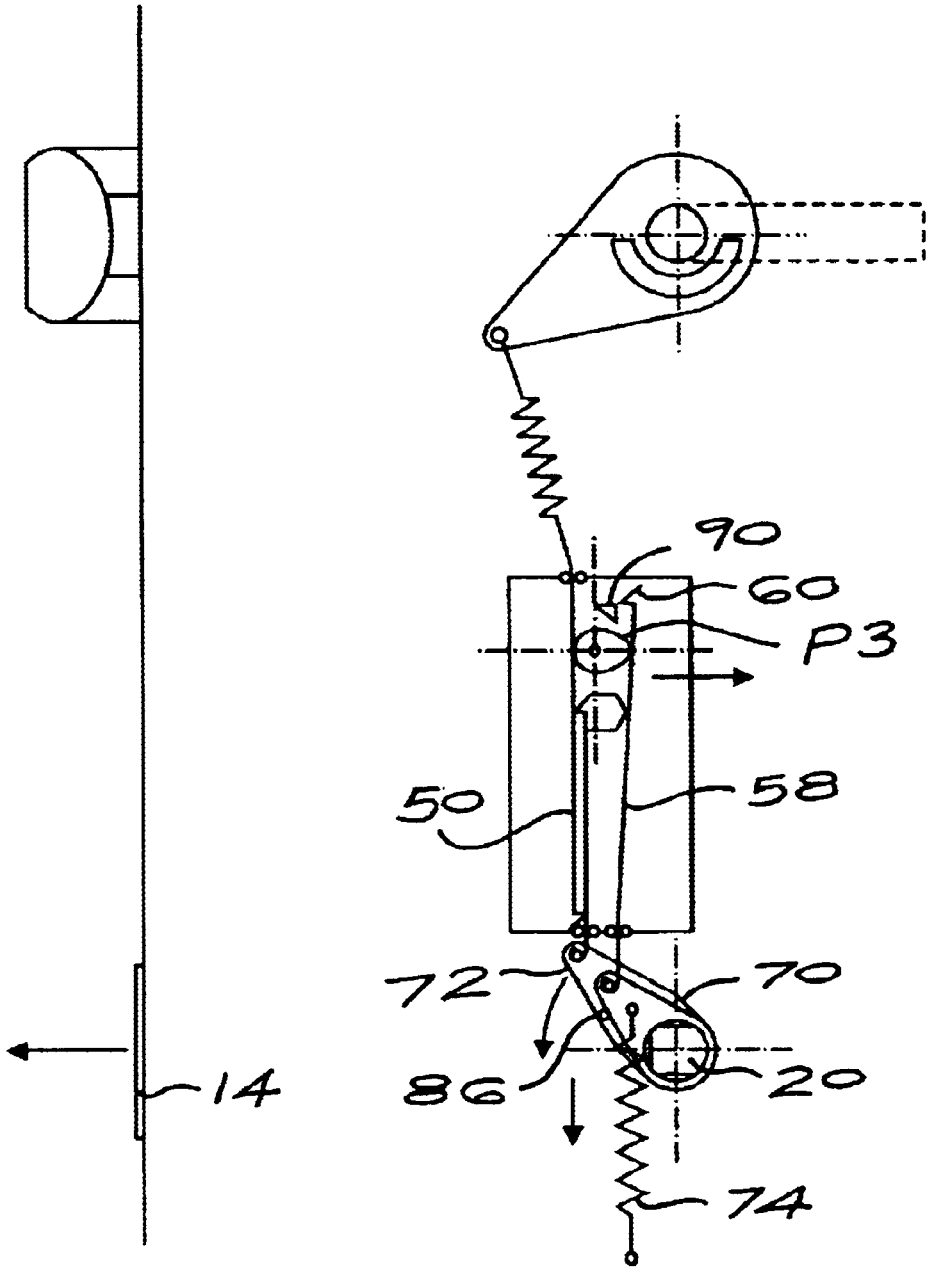
FIG. 12 illustrates the lock of FIG. 7 prior to the bolt extending.

To lock the door the user signals that he wants this operation to take place. The signal is transmitted from a remote control unit and is received by the receiver 32. If the signal is correctly decoded and identified then via the controller and the motor the cam is moved from the P1 position to a position designated P3 which is shown in FIG. 12. In this position the cam displaces the catch mechanism 58 to the right so that the hook formation 60 disengages from the retaining catch 90 on the plate 22. The spring 74, which is in an extended position, constantly exerts a force on the hold lever 70 which tends to rotate the hold lever 70 in an anticlockwise sense about the axle 20. As the hook formation 60 disengages from the retaining catch 90 the spring 74 causes the hold lever to rotate about the axle and the catch mechanism 50 is moved downwardly. A side surface of the hold lever 70 abuts the pin 86 and the unlock lever 72 is therefore rotated in unison with the hold lever. The unlock lever 72 causes rotation of the bolt axle 20 and the bolt 14 is then thereby moved to an extended or locking position.

The cam 24 does not remain in the P3 position but continues rotating to the P1 position. The lock is thus restored to the configuration shown in FIG. 7.

MANUAL UNLOCKING

If a user makes use of a key to unlock the door then referring to the configuration shown in FIG. 7 the user inserts the key into the lock cylinder (not shown) which operates on the box axle 20. As the key is turned the bolt axle 20 is turned and the bolt 14 is retracted. The unlock lever 72 moves in unison with the bolt axle and due to the engagement of the pin 86 with a side surface of the hold lever, the hold lever 70 is rotated as well. The spring 74 is tensioned. The catch mechanism 58 is placed in a position at which it engages with the retaining catch 90. The bolt is thereby kept in a fully retracted position The lock configuration is shown in FIG. 11.

MANUAL LOCKING

Figures 11, 11A:
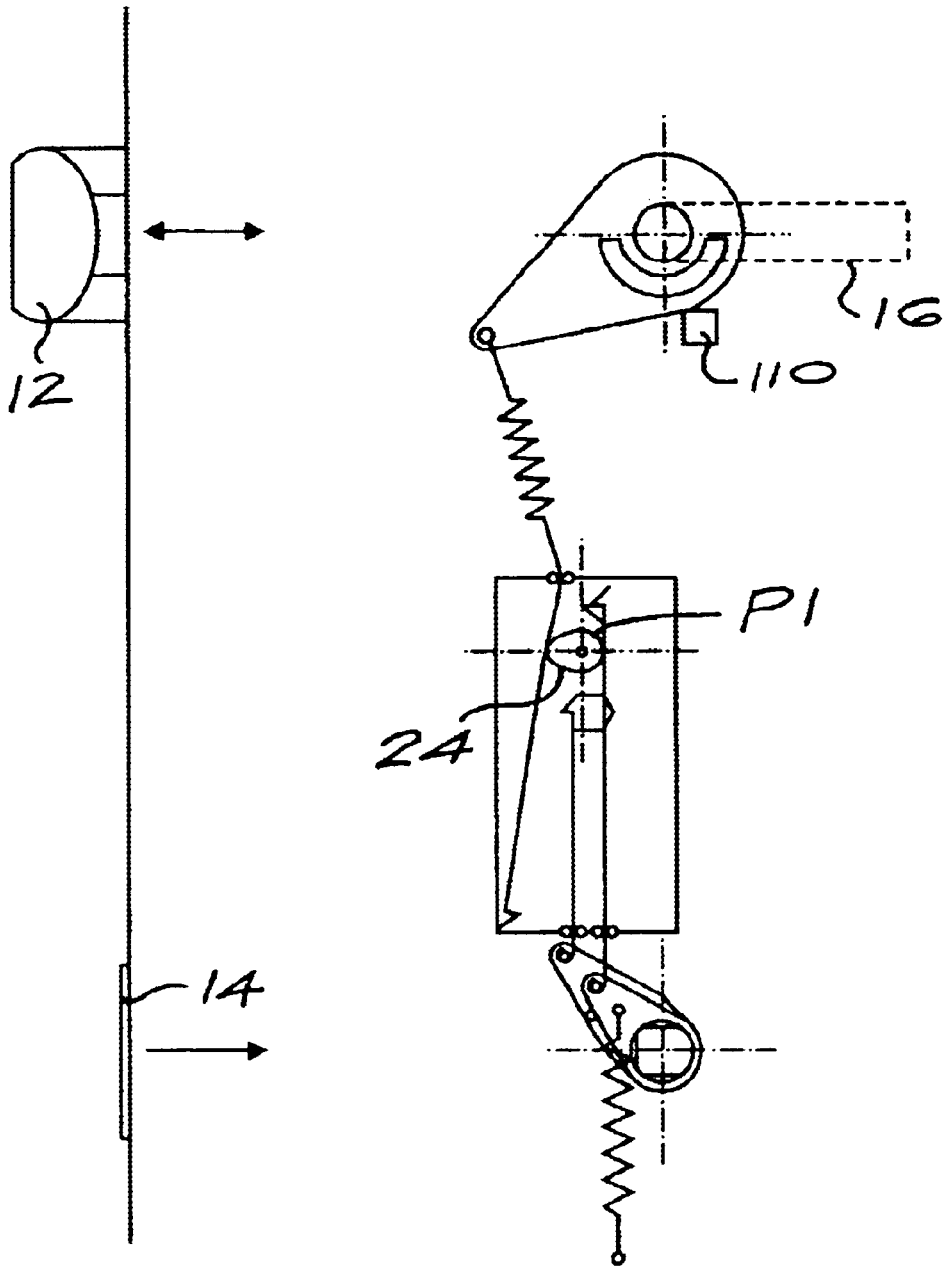
FIG. 11 shows the lock of FIG. 7 with the catch extending and the bolt retracted.
Figure 13A:
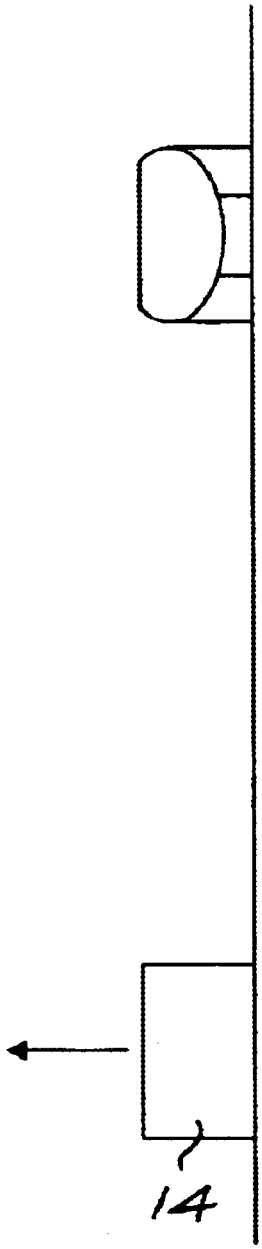
FIG. 13 shows the lock of FIG. 7 with the catch extended and with the bolt extending.
Figure 13:
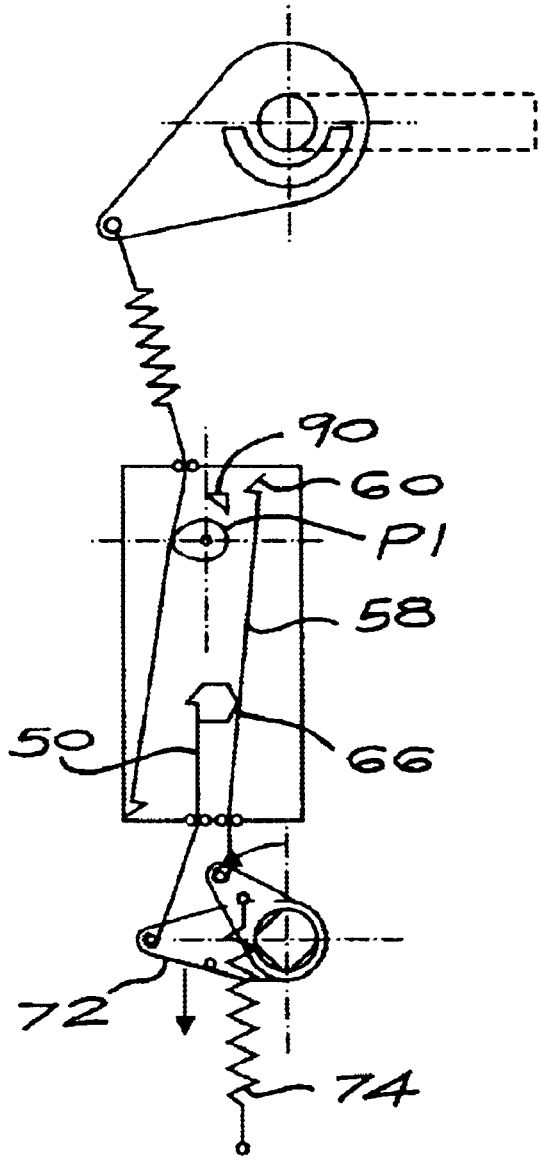

Manual locking commences when the lock is in the configuration shown in FIG. 11. The user uses a key to turn the bolt axle 20 which causes rotation of the unlock lever 72 and the component 50 is moved downwardly. The cam surface 66 at the upper end of the component 50 moves down the slot 64 in the catch mechanism 58 and then leaves the slot whereafter the cam surface deflects the catch mechanism to the right as is shown in FIG. 13 The hook formation 60 is thereby disengaged from the retaining catch 90. The extended spring 74 can then cause rotation of the hold lever 72 which causes corresponding further rotation of the axle 20. The bolt is thereby fully extended and the lock takes up the configuration shown in FIG. 7. The cam remains in the P1 position.

Figure 14:
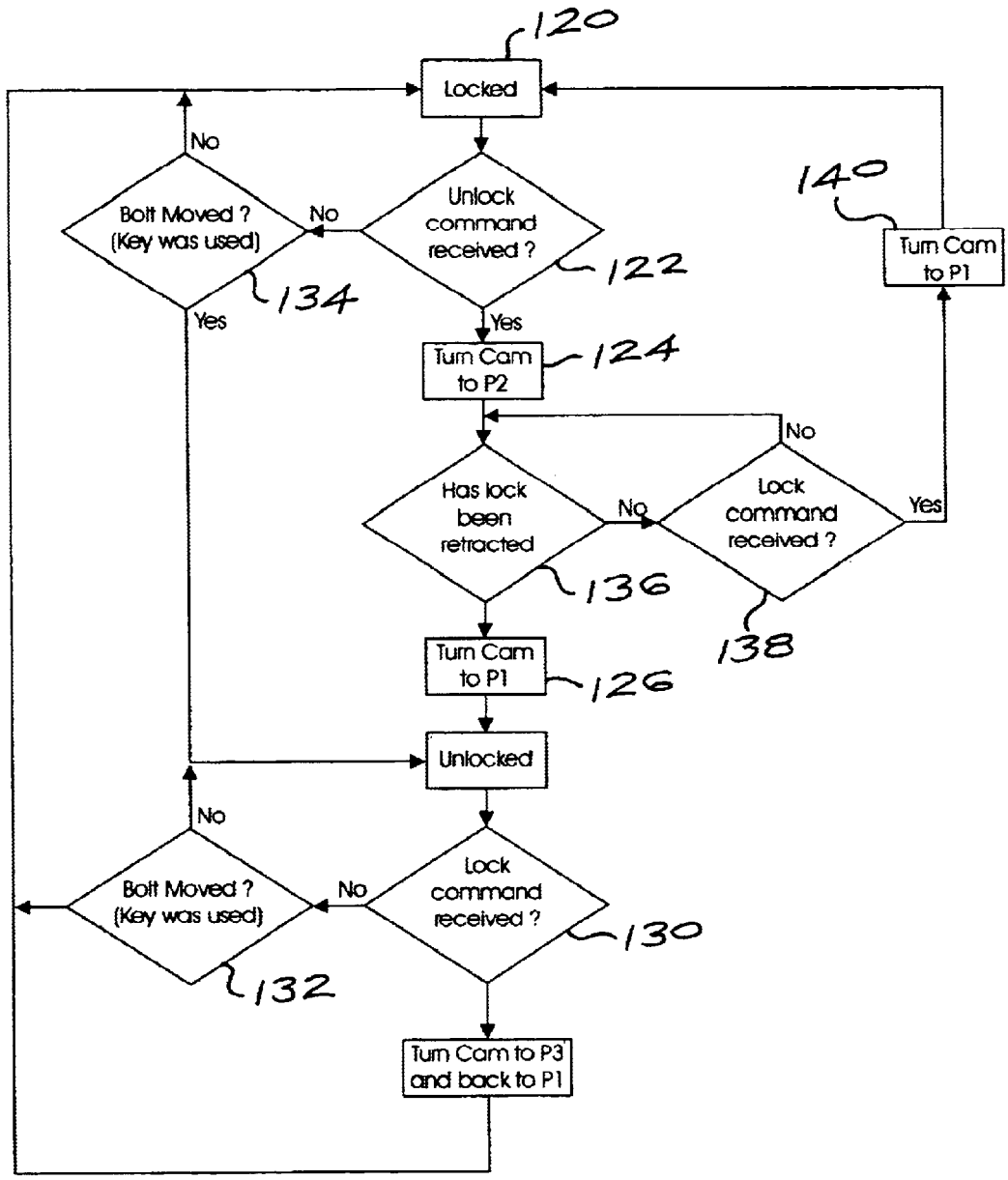
FIG. 14 is a flow-sheet illustrating different states of operation of the lock of FIG. 7 with the lock in different modes.

FIG. 14 is a flow-chart of the aforementioned sequence of operations. In block 120 the lock is the FIG. 7 configuration. An unlock command is transmitted by the remote control unit and is sensed by the control unit 30 in a step 122. If the signal is correctly identified the cam 24 is moved from the P1 position to the P2 position (step 124).

If the bolt has been retracted the cam is moved to the P1 position (step 126) and the door is then unlocked. If a command has been electronically generated to cause locking (step 130) then the cam is moved to the P3 position and back to the P1 position and the door is locked.

When the door is unlocked and a key is used for manual locking, ie. step 132, then the bolt is moved to the locked position (block 120).

If the door is locked, then block 134 indicates its manual unlocking.

If the bolt has not been retracted (block 136) and a lock command is received (step 138) then the bolt remains in the extended position and the cam is turned to position P1 (step 140).

The lock of FIGS. 1 to 13 is thus capable of being operated manually or electronically. In either mode of operation when the bolt is moved from an extended or locked position to a retracted or unlocked position energy is stored and the bolt is latched in the retracted position. Movement of the handle which operates the catch does not affect the position of the bolt. If the bolt is manually or electronically unlocked then the catch mechanism which retains the bolt in the retracted position is released and the energy in the stored spring is utilised to restore the bolt to the locked position.

The lock of FIGS. 15 to 26 is designed to address the problem referred to in the preamble hereof which is that, if the lock is not properly installed, it may be possible to open a door by releasing the catch and bolt, but that the bolt is not moved sufficiently for it to become latched in a fully open position. The bolt then moves to an extended position at which it prevents the door from being closed.

Figure 15:
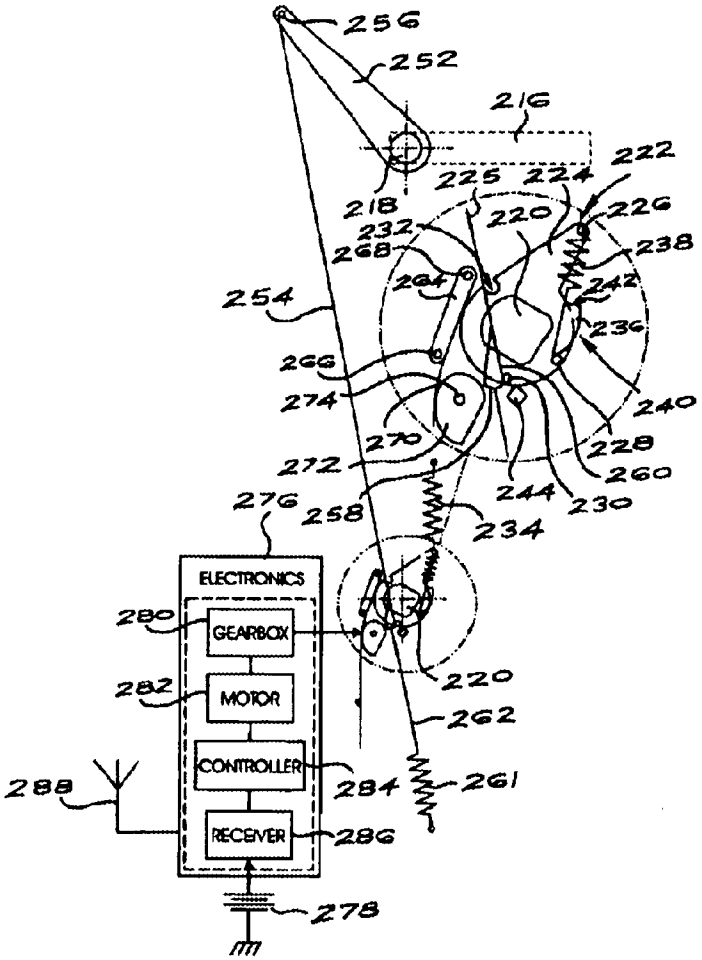
FIG. 15 illustrates principal portions of a lock according to a second form of the invention with the lock in a locked mode.
Figure 15A:
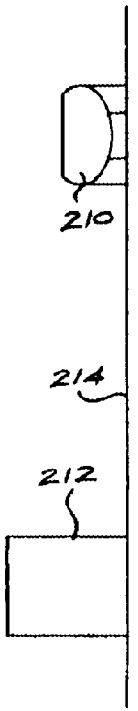

The lock shown in FIG. 15 includes a catch 210 and a bolt 212 which are mounted to a door 214 The catch is movable by means of a handle 216 which acts on a catch axle 218 against the action of a spring, not shown. The catch is movable linearly to-and-fro relatively to the door. The manner in which rotational movement of the axle 218 is translated into linear movement of the catch is known in the art and consequently is not further described herein. It is also to be understood that the arrangement of gearbox, motor, controller and receiver shown in FIG. 7 can be used for actuating the cam of the lock of FIGS. 15 to 26, and that the flow chart of FIG. 14 applies to the lock of FIGS. 15 to 26.

The bolt 212 is also mounted for linear movement relatively to the door. This is achieved by means of rotational movement of a bolt axle 220. Again the way in which this movement is achieved is known in the art and consequently is not further described herein. Normally the bolt axle is rotatable, at least from an outer side of the door by means of a key which is engaged with a separate lock cylinder not shown while from an inner side of the door the bolt axle is rotatable by means of a short twist lever not shown. These aspects are however known in the art.

An actuating mechanism 222 is mounted to the axle 220 and to surrounding structure. The actuating mechanism is shown in enlarged detail in FIG. 15 and various components thereof are shown, according to requirement, in insert drawings in at least some of the remaining FIGS. 16 to 25.

The actuating mechanism includes a bolt lever 224 which is mounted to the bolt axle 220. The bolt lever has three outwardly extending pins 226, 228 and 230 on one face, and a recessed formation 232 on an edge of the lever. A locking spring 234 acts on the bolt lever and biases the lever in an anticlockwise direction about the axle 220.

A bolt lever hook 236 extends from a spring 238 which is mounted to the pin 226. The hook 236 has a curved outer face 240 and a flat face 242. A catch 244 is mounted to fixed structure, not shown, of the lock.

A catch lever 252 is fixed to the catch axle 218. An elongate link 254 extends from a pivot point 256 on the catch lever to the bolt lever 224. At its lower end in the drawing the link 254 has a hook 258 and a spring lever 260 extends across an open side of the hook. The link 254 is urged downwardly by means of a spring 261 which is connected to the hook 258 by an extension piece 262.

A key disable lever 264 is mounted to a pivot point 266 which is attached to fixed structure of the lock (not shown). At an upper end, in the drawing, the lever has a pin 268. A spring 270 is fixed to a lower end of the lever and extends downwardly abutting a cam 272 which is mounted to an axle 274.

The cam is movable by means of an electronic system 276 which is powered by a battery 278. As has been indicated hereinbefore the electronic system is essentially of the kind shown in FIG. 7 in that it includes a gearbox 280 which is rotatable by means of an electric motor 282 which operates under the control of a control unit 284. The control unit in turn is operated by means of signals output by a receiver 286 which as an antenna 288 which receives radio signals from a remote control device which is normally handheld and which is not shown in the drawing. The kind of operation is common and is encountered for example in the remote opening of garage doors, gates and the like.

UNLOCKING THE LOCK ELECTRONICALLY

Figures 16, 16A:
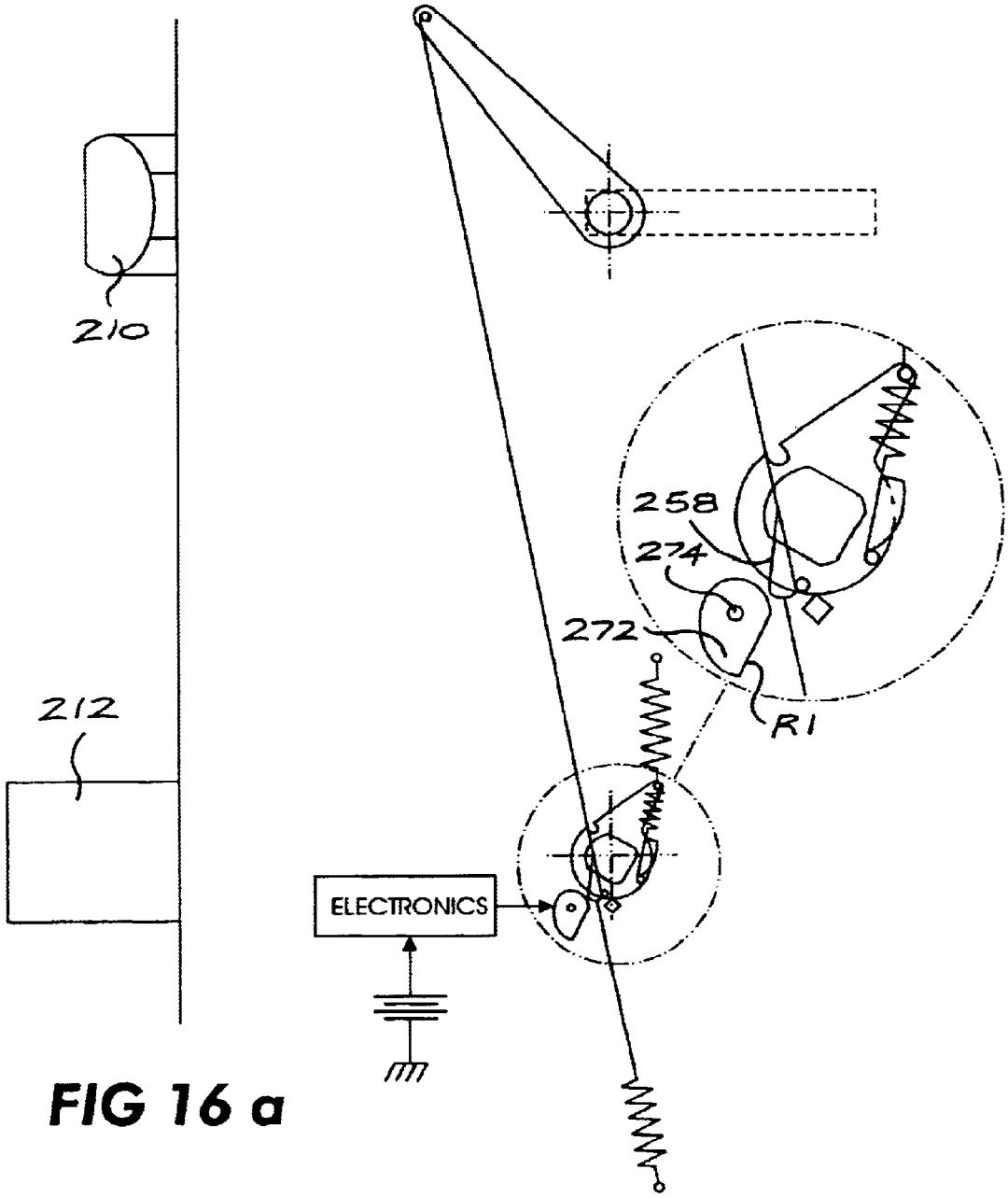
FIG. 16 is a simplified version of FIG. 15 again with the lock in a locked mode.

In FIG. 16 the lock is shown in the locked position. The cam 272 is shown in a position designated R1 which is such that it does not abut the hook 258 The hook 258 is not engage with the pin 230. The catch 210 and bolt 212 are fully extended. If the handle is operated the spring lever 260 will slide over the pin 230. Thus only the catch will be extracted if the handle is turned.

Figures 17, 17A:
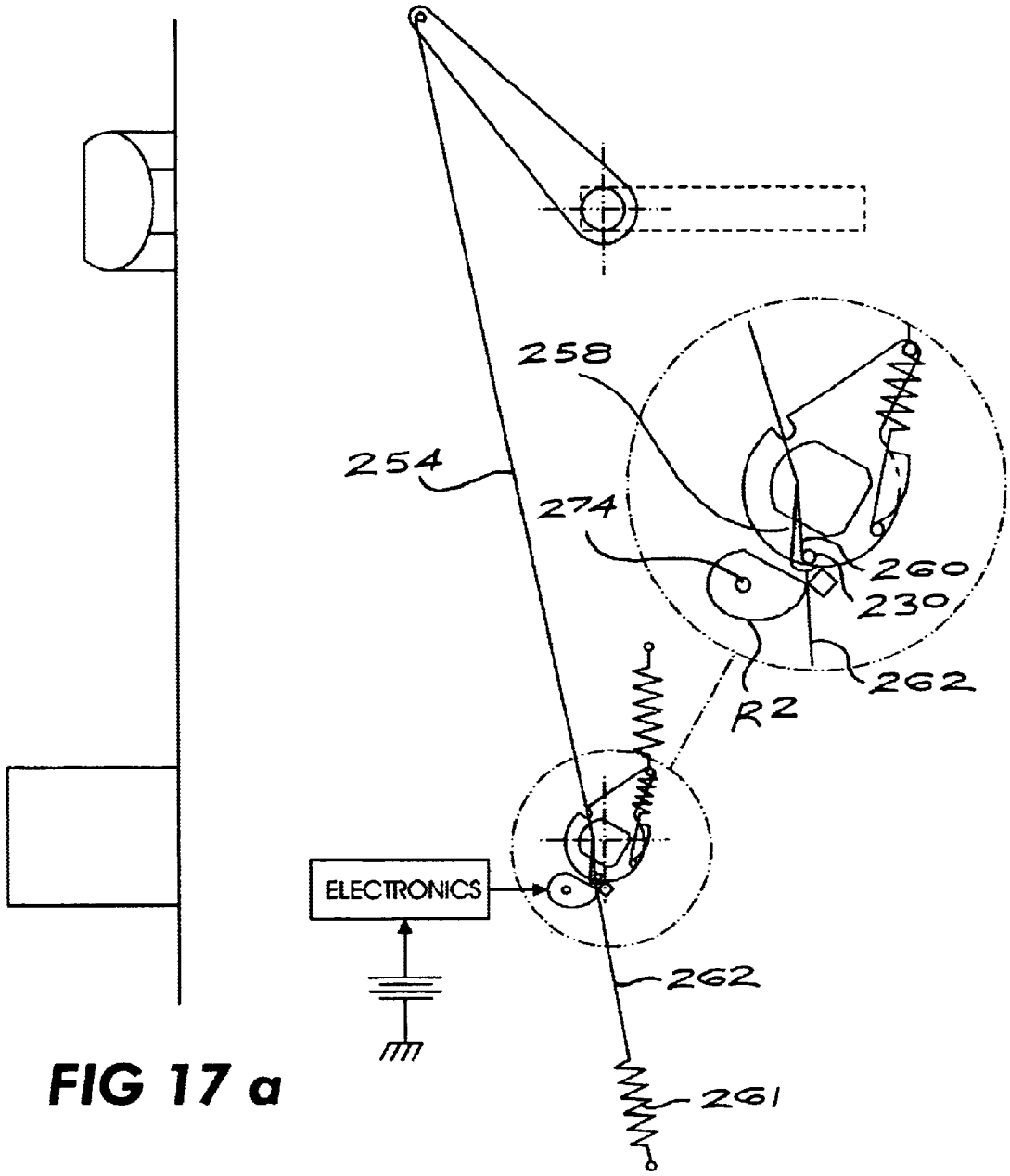
FIGS. 17, 18 and 19 illustrate successive stages of the lock of FIG. 15 being electronically actuated and with a handle being manually moved so that the lock is placed in an unlocked mode.

To place the lock in an unlocking mode the cam is caused to turn from the R1 position in FIG. 16 to a position designated R2 and shown in FIG. 17. A suitable signal is sent from a transmitter to the receiver 286 and under the action of the controller 284 the motor drives the gearbox 280 to cause movement of the cam about the axle 274. A surface of the cam is thereby brought into contact with the extension piece 262 which projects from the hook 258. The spring lever 260 is forced against the pin 230 and the hook 258 is able to engage with the pin 230.

Figures 18, 18A:
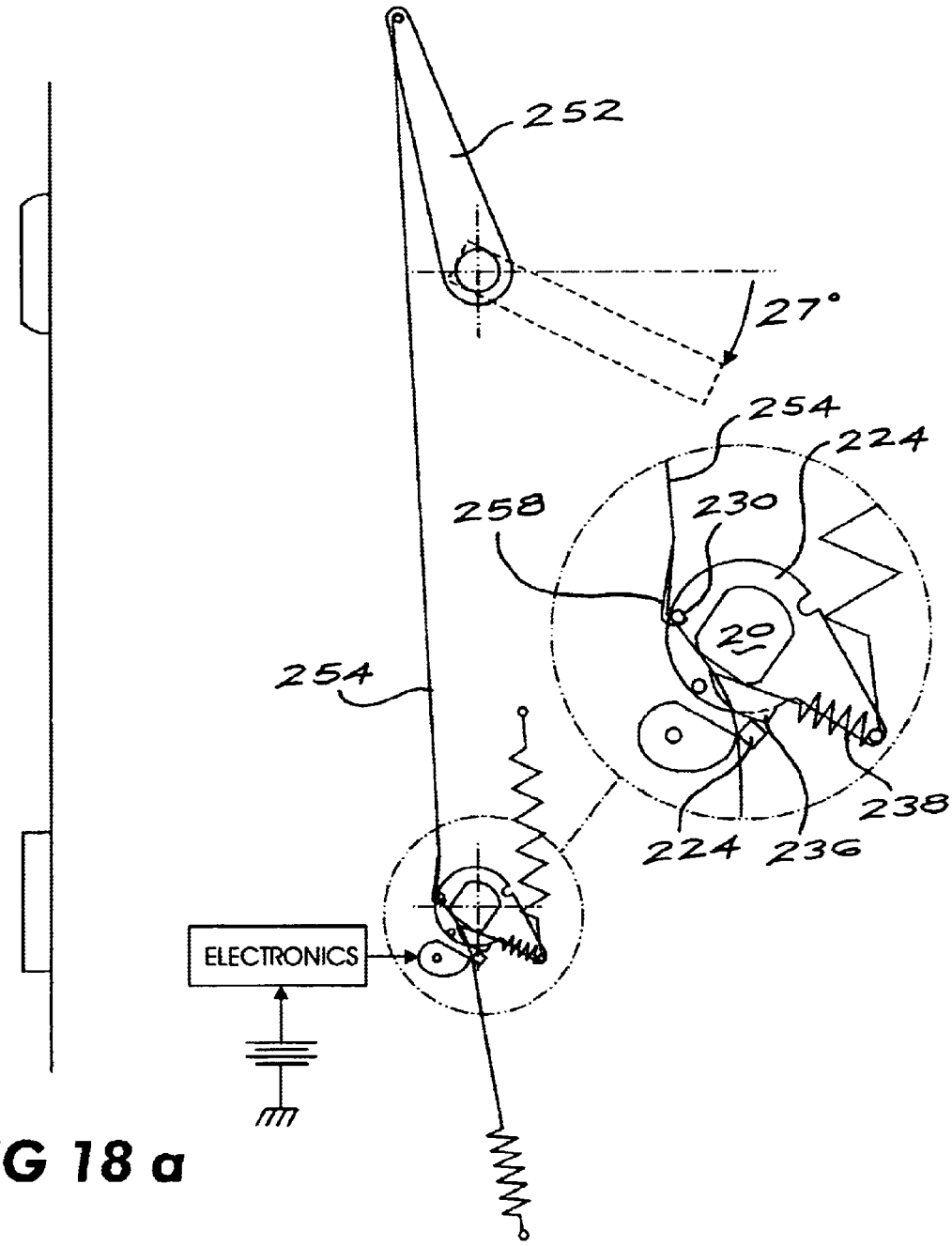

FIG. 18 shows the handle 216 rotated through approximately 27° in a clockwise direction. The catch lever 252 moves upwardly and the link 254 is also moved upwardly thereby causing the bolt lever 224 to rotate about the axle 220 with the hook 254 engaged with the pin 230.

Figures 19, 19A:
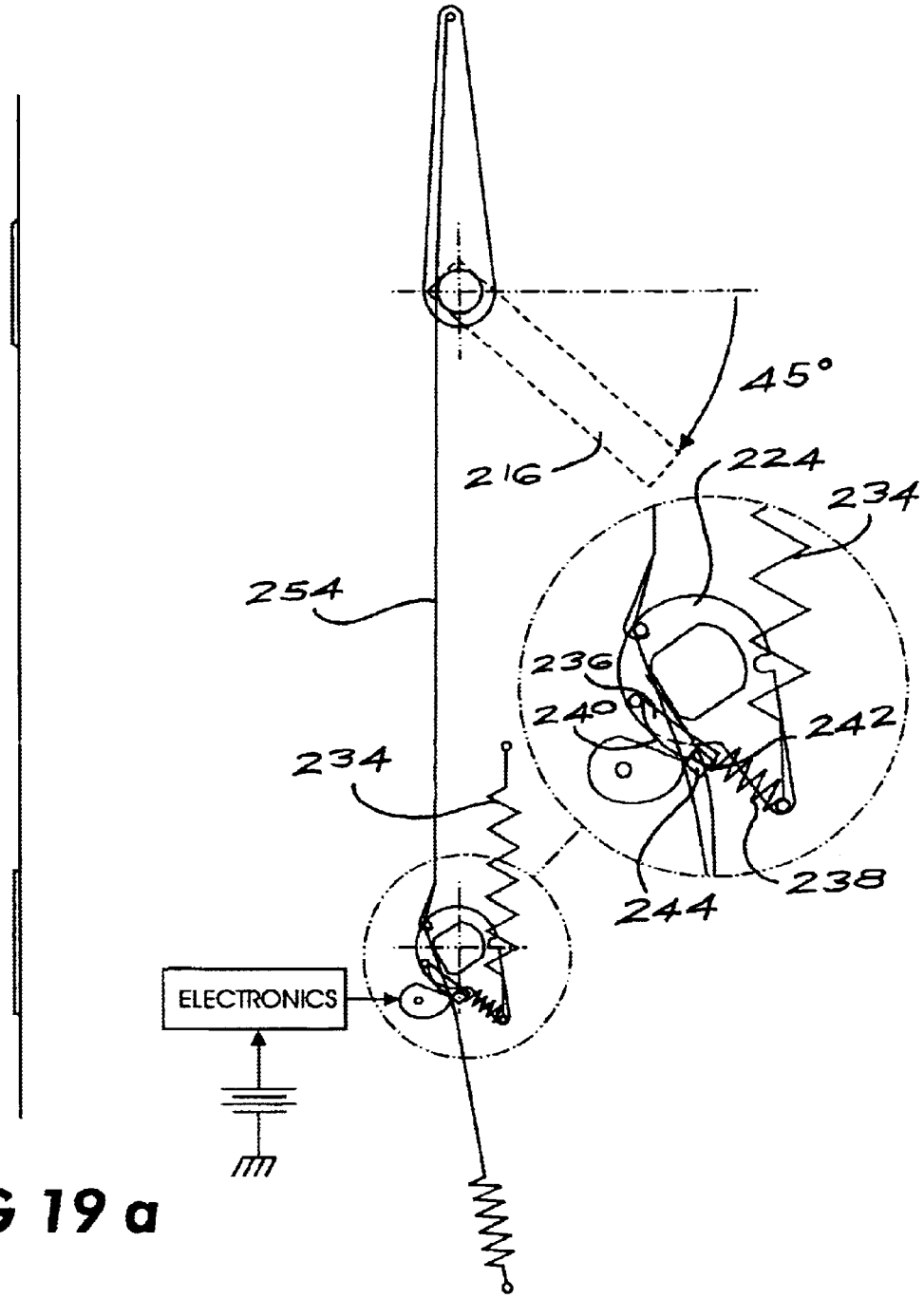

FIG. 19 shows the handle 216 rotated through 45° which is the maximum extent of rotation of the handle. The bolt lever 224 is also rotated to a maximum extent and, it is to be noted, the locking spring 234 is extended in the process. The hook 236 initially bears against the catch 244 with the curved outer surface riding over a corner of the catch, as shown in FIG. 18. The spring 238 allows lateral movement of the hook 236 relatively to the catch 244 to the extent which may be necessary. On the other hand when the flat face 242 reaches the catch 244 the spring 238 urges the hook 236 into engagement with the catch. The bolt lever 224 is thus retained in the FIG. 19 position.

As the handle 216 moves from the FIG. 17 to the FIG. 19 position the lever 252 is moved to a substantially vertical position. Initially the elongate link 254 is inclined substantially to the vertically while, in the FIG. 19 position, the link 254 is substantially vertical. It is also to be noted that the distance between the pivot point 256 and the catch axle 218 is materially greater than the distance between the axle 220 and the pin 230 on the bolt lever (see FIG. 15). It has already been pointed out that rotational movement of the catch axle is translated into linear movement of the catch and that rotational movement of the bolt axle is translated into linear movement of the bolt. Consequently, when the handle is rotated in the manner which has been described, and due to the geometry of the components used to transfer rotational movement of the catch axle into rotational movement of the bolt axle, a small turning angle of the handle 216 results in a much larger turning angle of the bolt axle initially on the start of the handle turn stroke, although to a lesser extent towards the end of the handle turn stroke. The bolt is therefore retracted to a greater extent than the degree to which the catch is retracted. In other words relatively early during the process of turning the handle the bolt is fully retracted and, ideally, is fully retracted before the catch is fully withdrawn. Preferably the catch is only fully withdrawn at the end of the handle rotation.

The bolt is preferably retracted faster, at least initially, than the catch. It is apparent that, in the example, the relative movements of the bolt and catch are dependent on the geometry of the operative components. In this respect the length of the bolt lever relatively to the length of the catch lever is important, as is the angle of the bolt lever relatively to the angle of the catch lever, at the start of the bolt retraction movement. These angles may be referred to as the "starting angles". By varying these parameters it is possible to achieve the desired movement of the bolt relatively to the catch.

The aforementioned mode of operation eliminates the problem, referred to hereinbefore, which may occur with a lock of type shown in FIGS. 1 to 13 which is that a door can be opened, by moving the handle, but in such a way that when the handle is released the bolt returns to a fully extending position.

Figure 26:
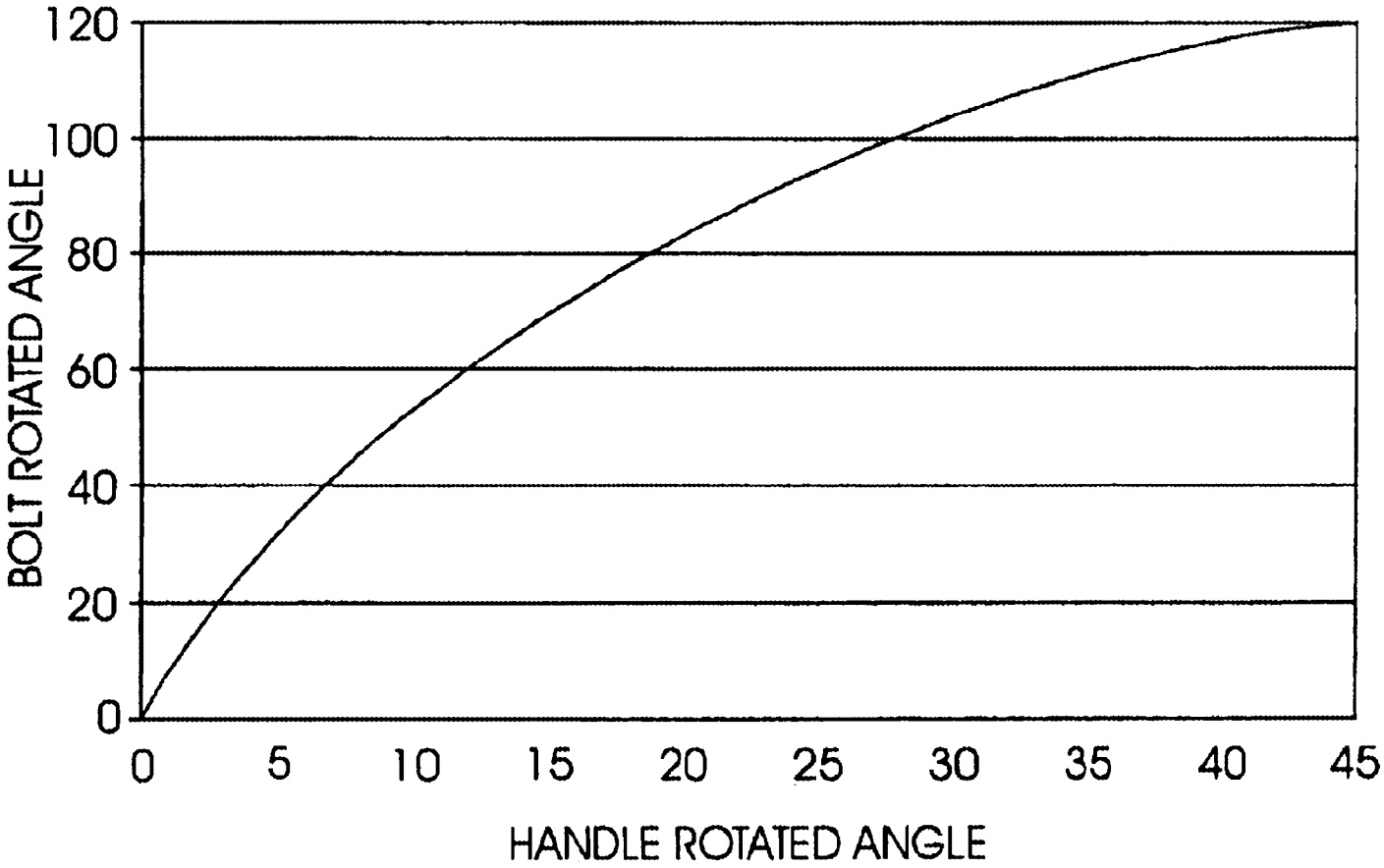
FIG. 26 illustrates graphically the relationship between bolt and handle movement in the lock of FIG. 15.

FIG. 26 shows a desired relationship between the bolt rotation angle (on the Y-axis) to the handle rotation angle (on the X-axis). It can be seen that a handle rotation angle of about 30° results in a bolt rotation angle of about 60° . On the other hand, towards the end of the handle rotation, the degree of angular movement of the bolt is less than what occurs at the beginning of the handle movement.

Figures 20, 20A:
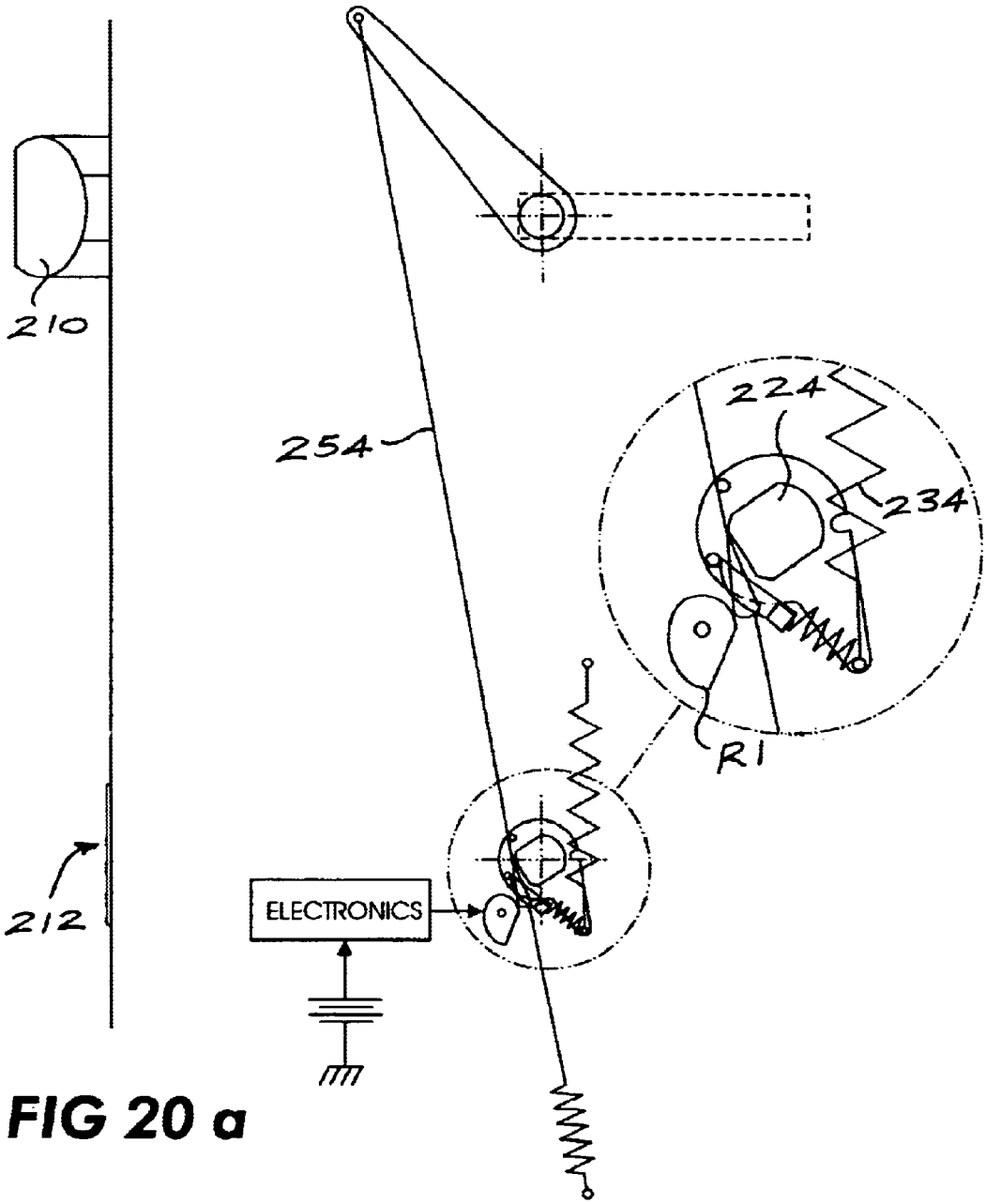
FIG. 20 shows the lock of FIG. 15 with the handle released and with the lock unlocked.

FIG. 20 illustrates the components of the lock when the handle is released and the bolt is held in a fully retracted position.

LOCKING THE LOCK ELECTRONICALLY

Figures 21, 21A:
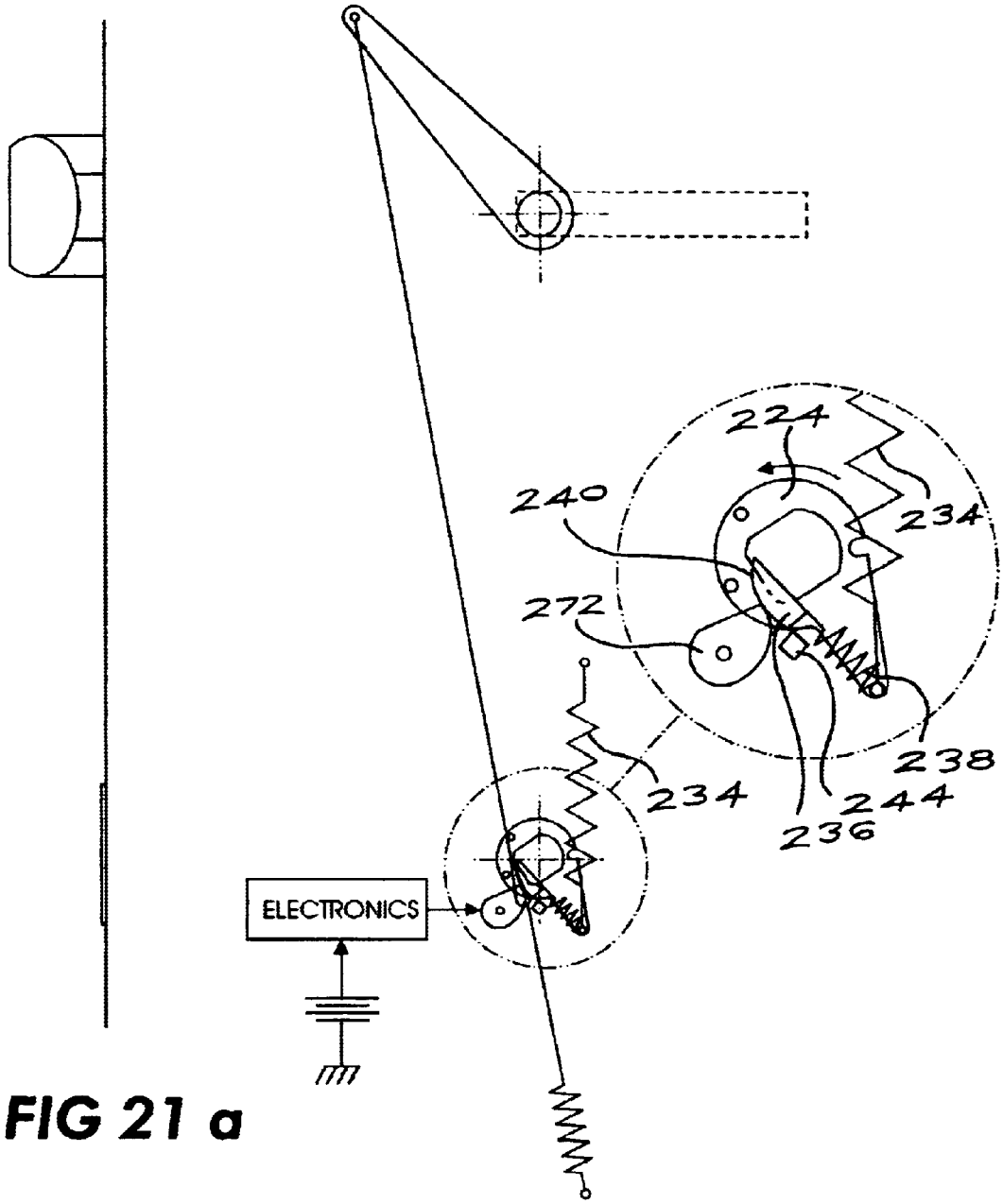
FIG. 21 illustrates electronic locking of the lock of FIG. 15.
Figures 22, 22A:
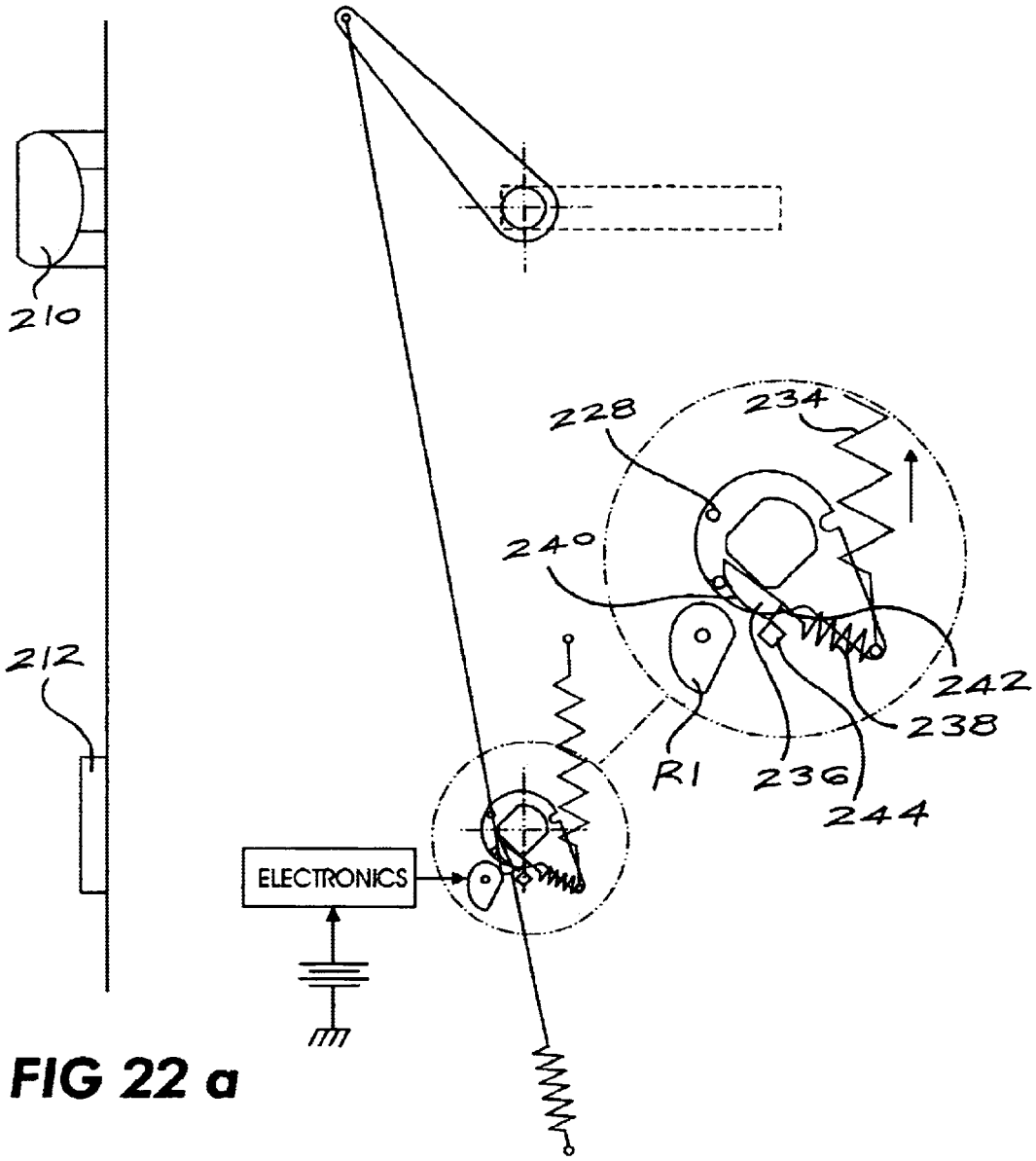
FIG. 22 illustrates the lock of FIG. 15 being manually locked ie. by means of a key.

In order to lock the lock electronically the cam is caused to rotate from the R1 position through 360° in a clockwise direction, back to the R1 position. During this movement, as is shown in FIG. 21, the cam bears against the curved outer face 240 of the hook 236 thereby deflecting the hock so the right, with this movement being allowed for by flexure of the spring 238. Once the hook 236 is disengaged from the catch 244 the bolt lever 224 is free to rotate in an anticlockwise direction under the action of the locking spring 234. The bolt is then linearly moved to its extended position which is shown in FIG. 15.

UNLOCKING WITH A KEY

If a key is used to unlock the lock then, initially, the lock is in the configuration shown in FIG. 16. The key acts on a mechanical key cylinder of a kind which is known in the art and which is therefore not further described herein. The cylinder in turn acts on the bolt axle 220. As the user turns the key the bolt lever is turned, the locking spring 234 is extended, and the bolt is retracted. The hook 236 rides over the catch 244 and in a manner similar to that which has been described the flat face 242 is ultimately brought into locking engagement with the catch with the lock components in the FIG. 20 position. The lock has thus been unlocked manually.

LOCKING WITH A KEY

When the lock is locked using a key the system starts out as in FIG. 20. The key acts on the lock cylinder and causes rotation of the bolt axle and the bolt lever. As the bolt lever is turned in a clockwise direction the pin 228 moves in under the curved face 240 of the hook 236 (see FIG. 2), lifting the hook 236 and sliding the face 242 over the catch 244. The spring 238 is extended for the face 242 remains engaged at least initially, with the catch 244. The hook is displaced out of engagement with the catch and the spring 238 then retracts drawing the hook away from the catch The locking spring 234 can then cause further rotation of the bolt lever, in an anti-clockwise direction so that the bolt 212 is fully extended thereby completing the locking action.

KEY DISABLE MODE

It is desirable to be able to place the lock into a key disable mode in which a key is prevented from being used to unlock the lock. The lock can however still be locked using a key.

Figures 23, 23A:
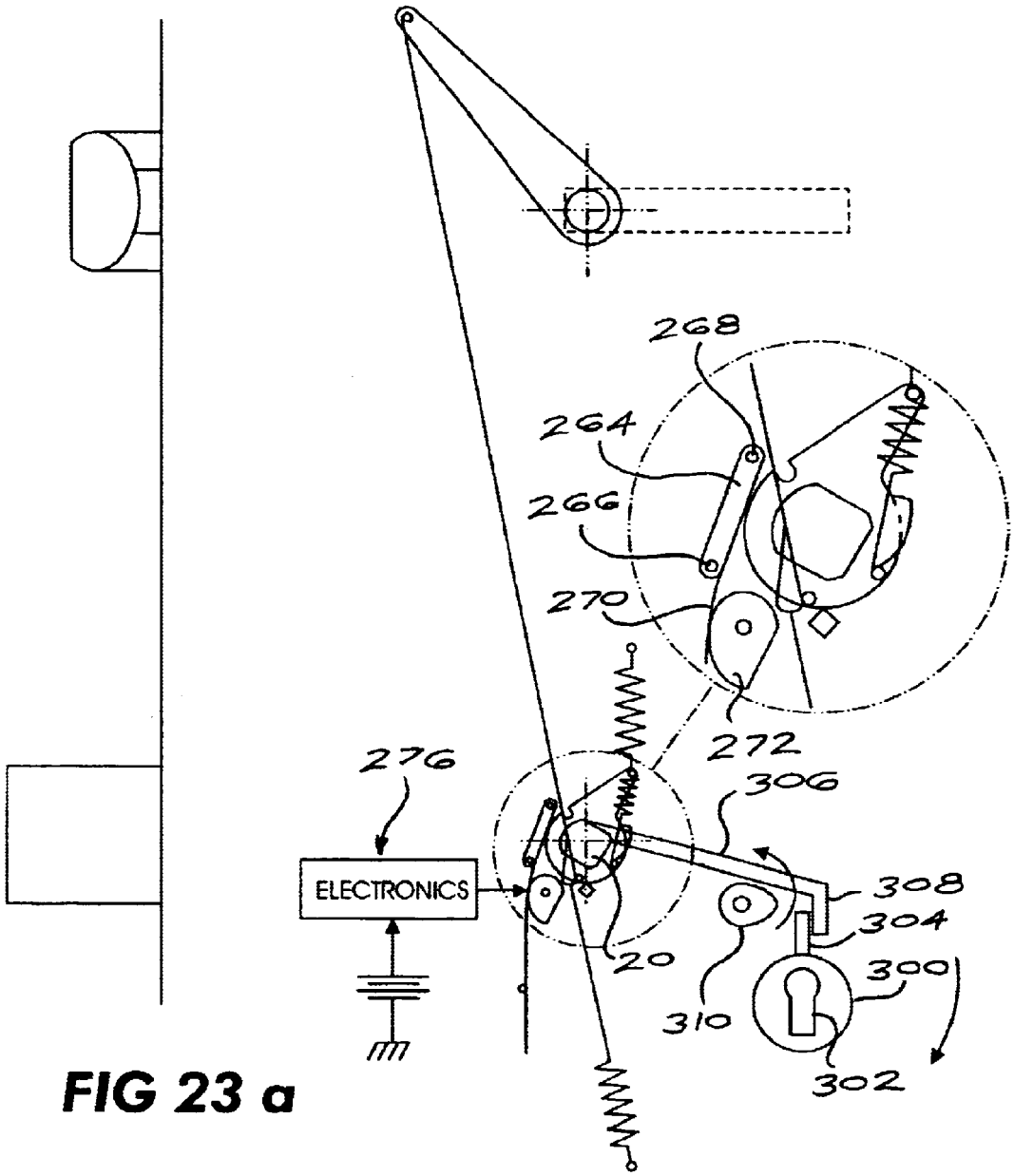
FIGS. 23 and 24 illustrate the lock of FIG. 15 in a locked position but being placed into a key disabled mode.
Figures 24, 24A:
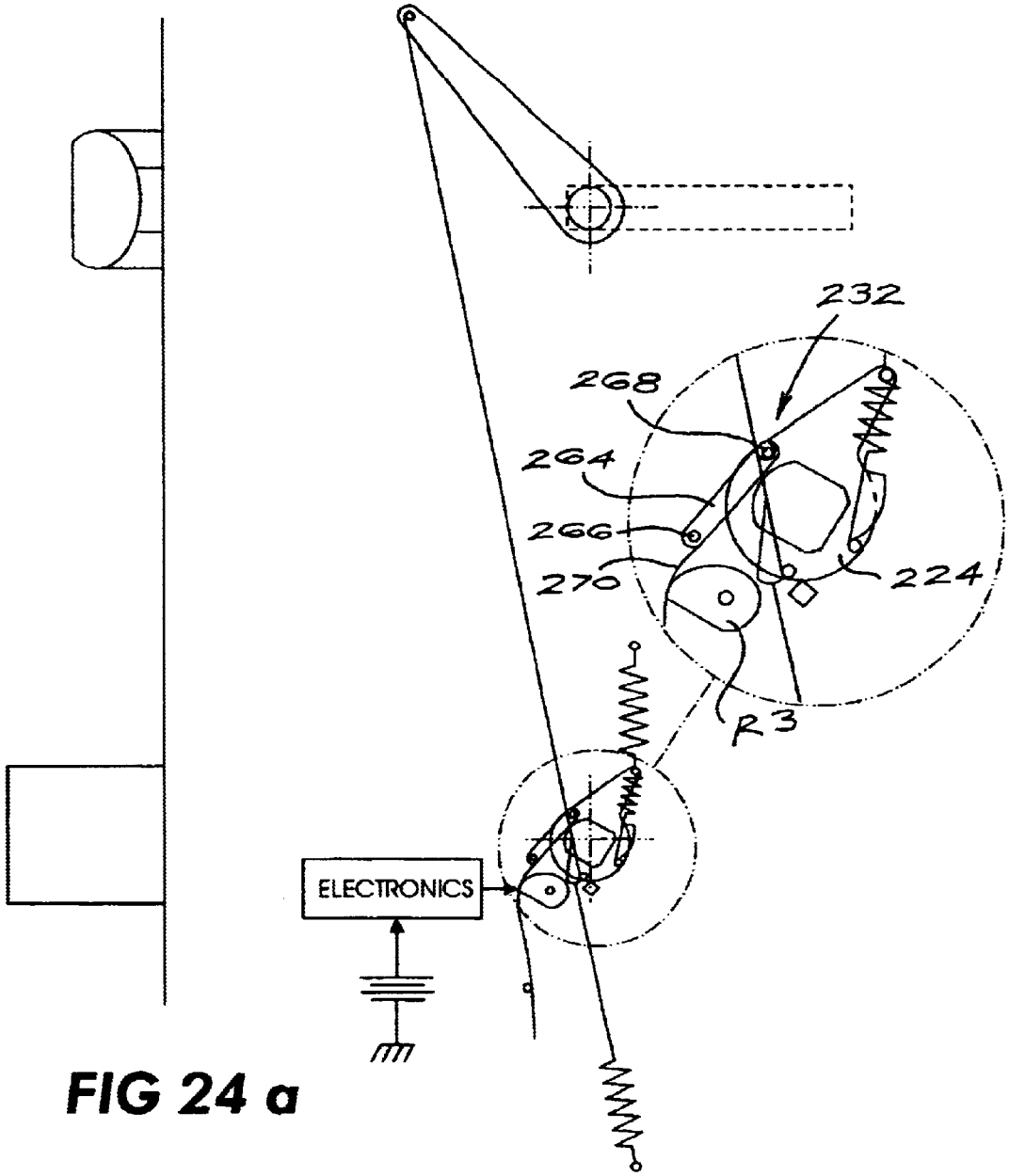

FIG. 23 shows the lock in a locked position but with the key disable mode not activated. When the lock is to be placed in the key disable mode the electronic actuating system 276 is operated to move the cam 272 to a position designated R3, as shown in FIG. 24. The cam bears against the spring 270 causing the lever 264 to rotate about the pivot point 266 so that the pin 268 can engage with the recessed formation 232 in the bolt lever 224, as shown in FIG. 24. This prevents the bolt lever from being rotated. Consequently a key cannot be used to turn the bolt lever and the bolt 212 remains the extended position.

The software in the controller 284 prevents the lock from being placed in the key disable mode unless the cam is operated so that it is turned to the R3 position. Clearly it is not possible to place the lock in a key disable mode when the bolt is fully withdrawn for, at this stage, the bolt lever is in the position shown in FIG. 19. However once the bolt lever returns to the FIG. 24 position the pin 268 will again automatically engage with the recessed formation 232.

Figures 25, 25A:
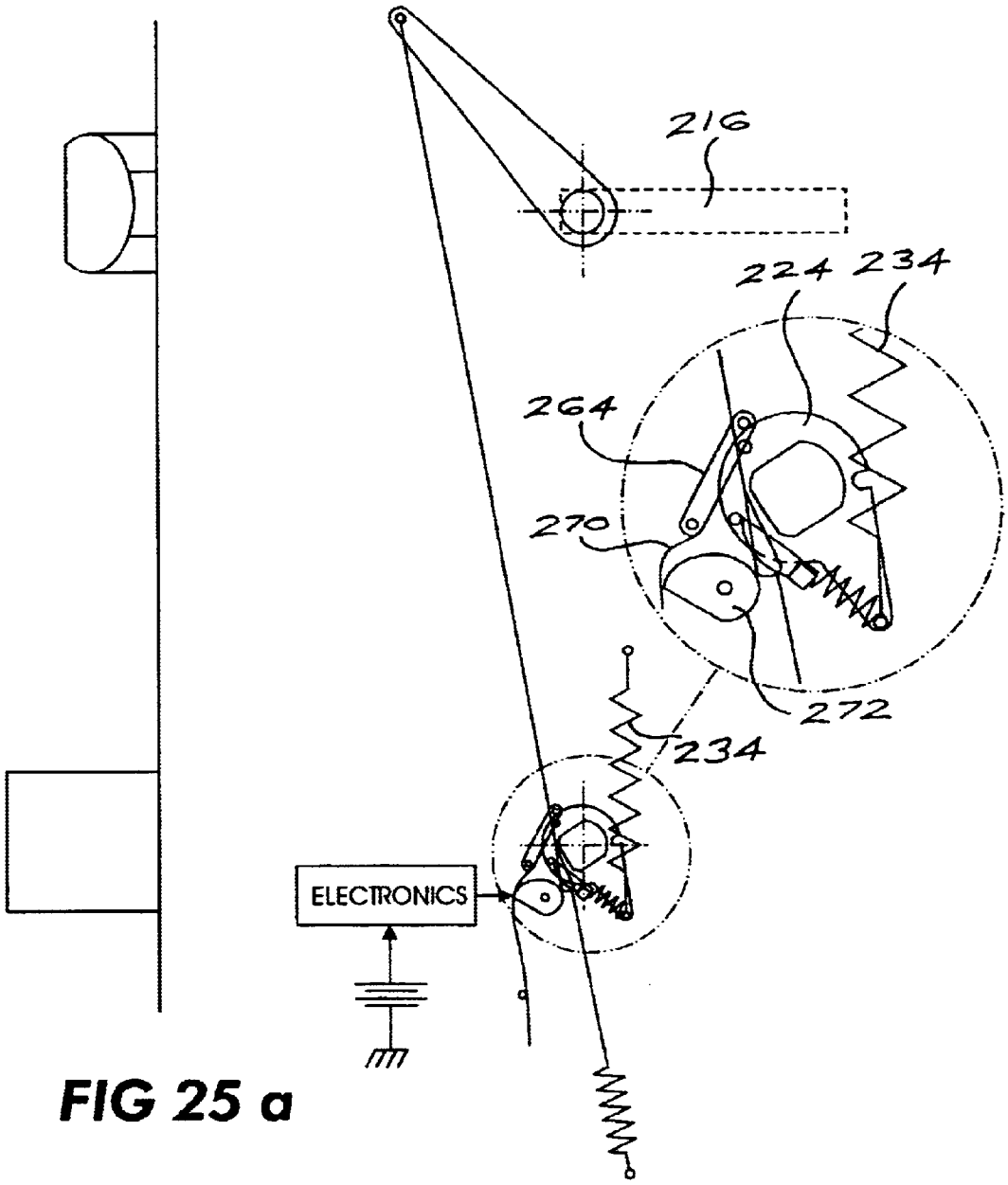
FIG. 25 shows the lock of FIG. 15 in an unlocked position and being placed into a key disabled mode.

FIG. 25 illustrates the situation which arises when the key disable mode is entered when the door is unlocked. The spring 270 bends to take up the distortion caused by the pin 268 pressing against the bolt lever. As stated, if the bolt lever rotates sufficiently far in an anticlockwise direction the pin 268 is able to enter the recessed formation 232 thereby engaging the disabled key disable mode. At this stage though the bolt 212 would be fully extended.

The lock can be placed in a key disable mode in a variety of different ways, and FIG. 23 illustrates schematically a key cylinder 300 of conventional construction, which includes a keyhole 302 into which a key, not shown, can be inserted to cause movement of a projection 304. This type of action is known in the art.

A lever 306, which is pivotally attached to the bolt axle 20, has a hook 308 which engages with the projection. Rotation of the projection in a clockwise sense, by actuating the key cylinder, thus causes rotation of the bolt axle, and retraction of the bolt.

A cam 310 is movable in a manner similar to the cam 272 by means of a drive chain (not shown) which is similar to the gearbox/motor/controller/receiver assembly shown in FIG. 15. If the cam is caused to rotate upwardly, from the illustrated position, then the lever 306 is raised by the cam and the hook 308 is disengaged from the projection 304. The key cylinder can then be moved freely without causing movement of the bolt axle, or the bolt, and the lock is therefore in a key disable mode.

The embodiments of the invention shown in FIGS. 27 to 34 are concerned generally with providing a remotely controlled facility which is used to inhibit the use of a key to unlock a lock or to lock a lock, according to requirement. The lock may of a conventional kind eg. a mortise lock or a cylinder lock or it may for example be of the type described in the specification of international application No. PCT/ZA99/001116, or the lock may be of any other type.

In the following description reference is made to three examples which are based on the use of a mortise type lock. It is to be understood that this is given merely by way of example and again, the invention is not limited in this regard.

Figure 27:
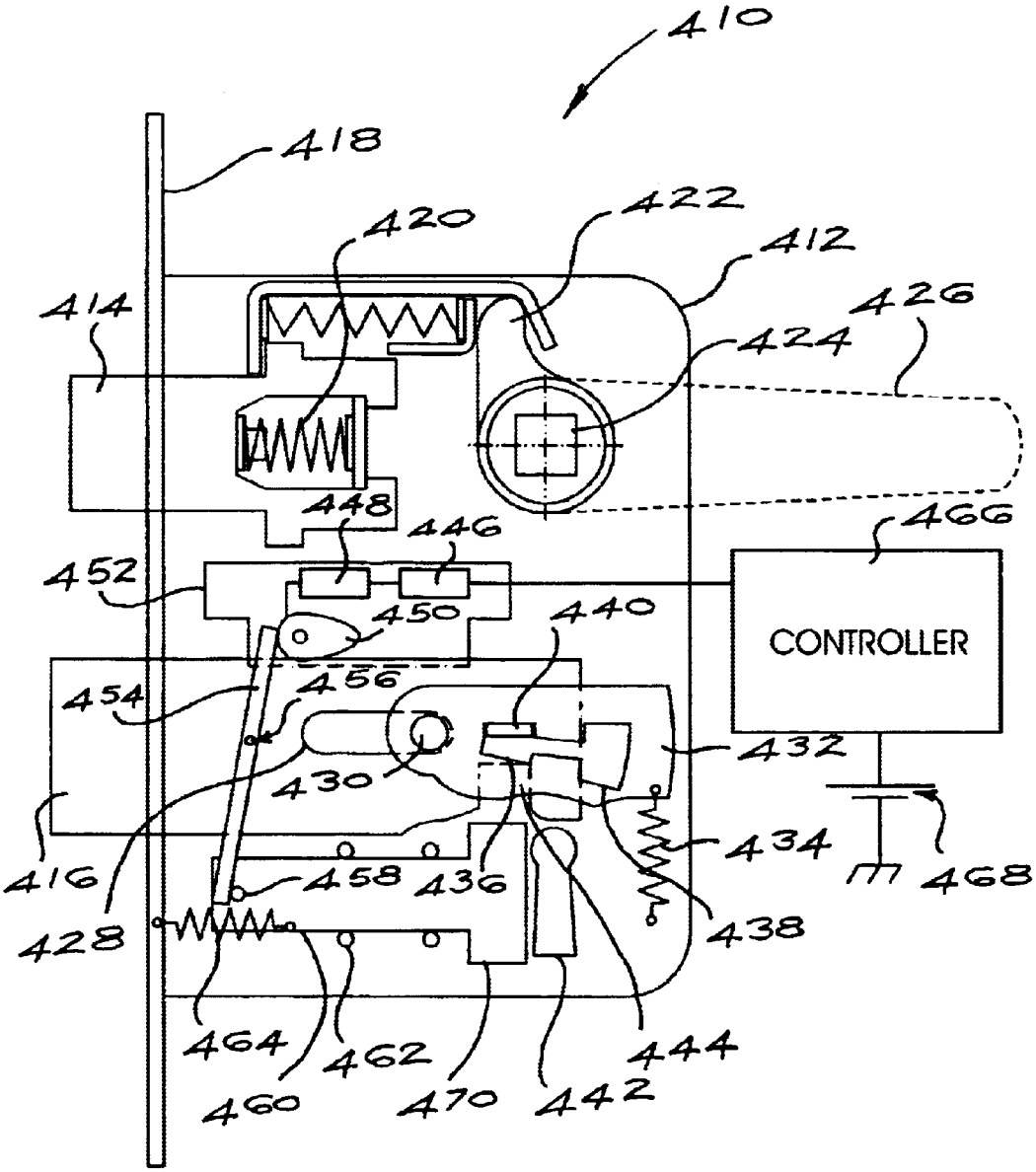
FIGS. 27 and 28 depict a lock according to a further embodiment of the invention in key enabled and key disabled modes respectively.

FIG. 27 of the accompanying drawings illustrates a mortise type lock 410 which includes a housing 412 in which are mounted a latch 414 and a bolt 416. The latch and the bolt extend through apertures formed in a plate 418 which is attached to the housing.

The latch is biased by means of one or more springs 420 and is movable in a manner known per se by means of a lever 422 which is mounted to a square shaft 424 which is rotatable by means of a handle 426 shown in dotted outline. These aspects are substantially conventional and consequently are not further described herein.

The bolt 416 has an elongate slot 428 which is engaged with a guide pin 430. A plurality of levers 432 are mounted for pivotal movement to the pin. Only one lever is shown in the drawing. The levers are biased downwardly by means of a spring 434. The levers have internal catch formations 436 and 438 which are engageable with an outwardly projecting catch 440 on a side of the bolt 416. The catch 440 is shown in FIG. 27 engaged with the catch formations 436.

A keyhole 442 is formed in the housing. If a correct key is inserted into the keyhole then, when the key is rotated, the levers are raised and are disengaged from the catch 440. Further rotation of the key, in the appropriate direction, causes the key to engage with a recessed formation 444 in the bolt and the movement of the key then causes sliding movement of the bolt 416 from the illustrated extended position to a retracted position at which the bolt is wholly inside the housing. When the key is further rotated the spring 434 acts to pull the levers downwardly. Again it is to be noted that this type of operation is substantially conventional and consequently is not further described in detail herein.

Mounted inside the housing 412 is a miniature motor 446 and a gearbox eg. a worm drive 448 which is driven by the motor. The gearbox in turn acts on a cam 450. The components 446 and 448 are mounted inside a casing 452 and the cam 450 is on an outer side of the casing.

A relatively thin lever 454 is mounted to a pivot point 456 on an inner surface of the housing 412. An upper end of the lever is adjacent a surface of the cam 450. A lower end of the lever bears against a pin 458 which projects from a blocking member 460 which is mounted for sliding movement inside guide formations or rollers 462. A spring 464 acts on the blocking member to move it to the left in the drawing.

The lock includes a controller 466 and a battery 468. These components are shown as being external to the housing 412. This is by no means essential though for the controller and the battery could be positioned inside the housing. The controller 466 is responsive to a remotely generated signal or signals. The nature of the remote signal is not restrictive for the controller may be responsive to an optical signal, a radio signal an infrared signal a signal which is transmitted over a conductor or the like. The controller may include logic of the type known in the art which can establish whether a signal is a valid signal in order to cause operation of the controller. For example use may be made of coded signals and the controller may include logic for rejecting incorrectly coded signals and for accepting only correctly coded signals. These aspects are similar to which is described in the specification of international application No. PCT/ZA99/00116.

With the lock 410 in the configuration shown in FIG. 27 a key can be inserted into the key hole 442 and the bolt can be actuated, in a conventional manner, by means of the key.

If a predetermined signal is received by the controller 466 then the controller interprets this signal as an instruction to inhibit operation of the lock by means of a key. When the signal is received the motor 446 is engerised by means of the battery 468 and the gearbox 448 is driven thereby to rotate the cam through 180° from the position shown in FIG. 27 to the position shown in FIG. 28. Rotation of the cam causes the lever 454 to pivot in an anti-clockwise direction about the pivot point 456. Consequently the lower end of the lever move to the right and, as the lever bears on the pin 458, the blocking member 416 is moved to the right against the biasing action of the spring 464. This movement is guided by means of the guide 462.

The right-hand end of the blocking member carries an enlarged plate 470 which obscures the key note 442 when the blocking member is moved fully to the right. Consequently it is not possible for a key to be inserted into the keyhole to operate the bolt. The invention thus provides a remote control facility to inhibit key operation of the lock.

Figure 28:
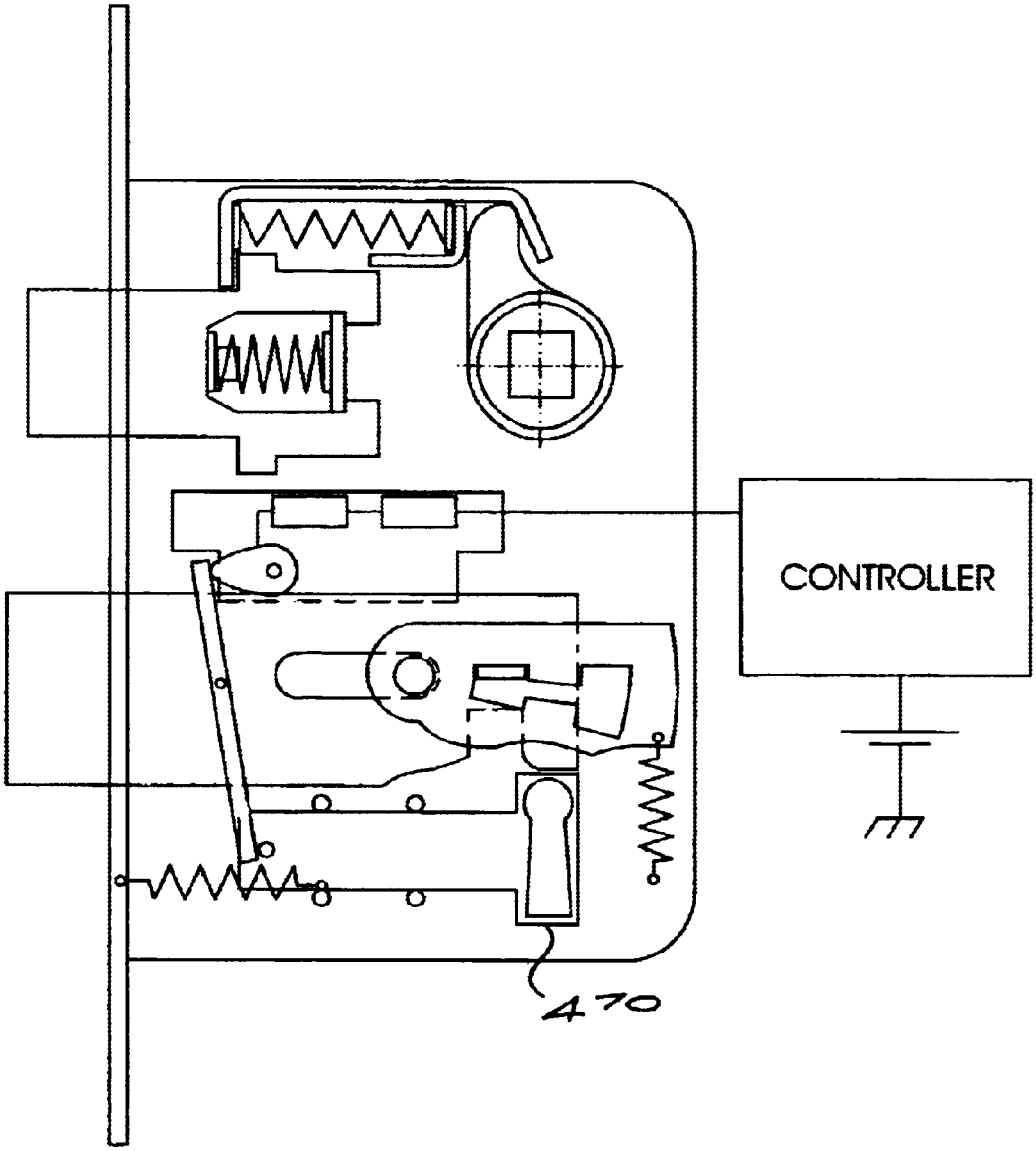

In the arrangement shown in FIGS. 27 and 28 the blocking member is used to prevent a key from being employed to unlock the bolt. In an alternative mode of operation the blocking member can be used to block the keyhole 442 when the bolt is in an unlocked position. In this way the key cannot be used for causing movement of the bolt 416 from an unlocked position to a locked position.

If the controller receives a further or second predetermined signal then the cam 450 is caused to rotate from the FIG. 28 to the FIG. 27 position. The force which is exerted by the lever 254 on the blocking member is released and the spring 264 restores the blocking member to the left-hand position shown in FIG. 27.

Since locks of this nature usually have two keyholes (one on an inner side, and the other on an outer side of the door), the blocking member 460 may be formed to cover both keyholes or only one (inside or outside), depending on the situation and usage of the lock.

Figure 29:
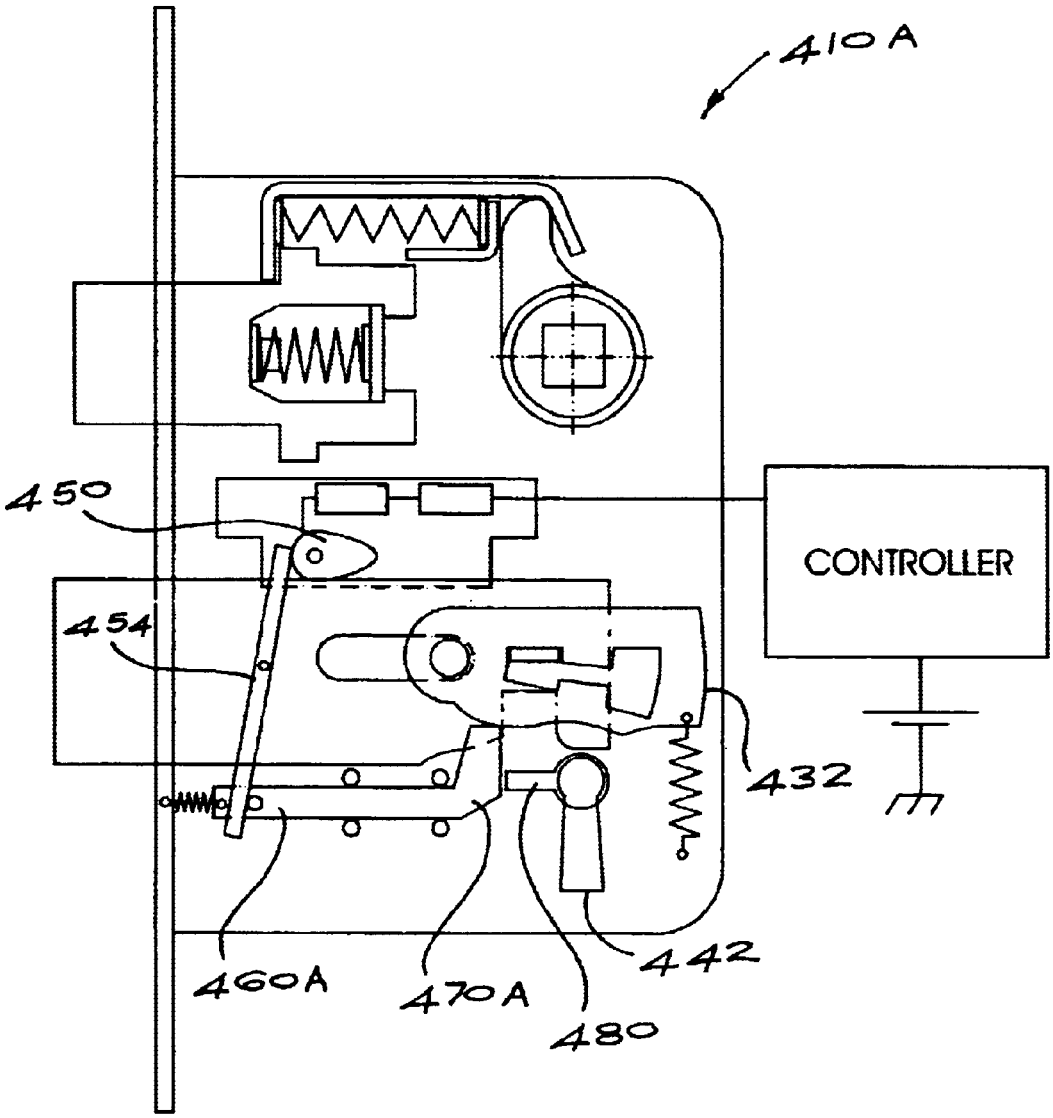
FIGS. 29, 30 and 31 illustrate a lock according to another form of the invention in different modes
Figure 30:
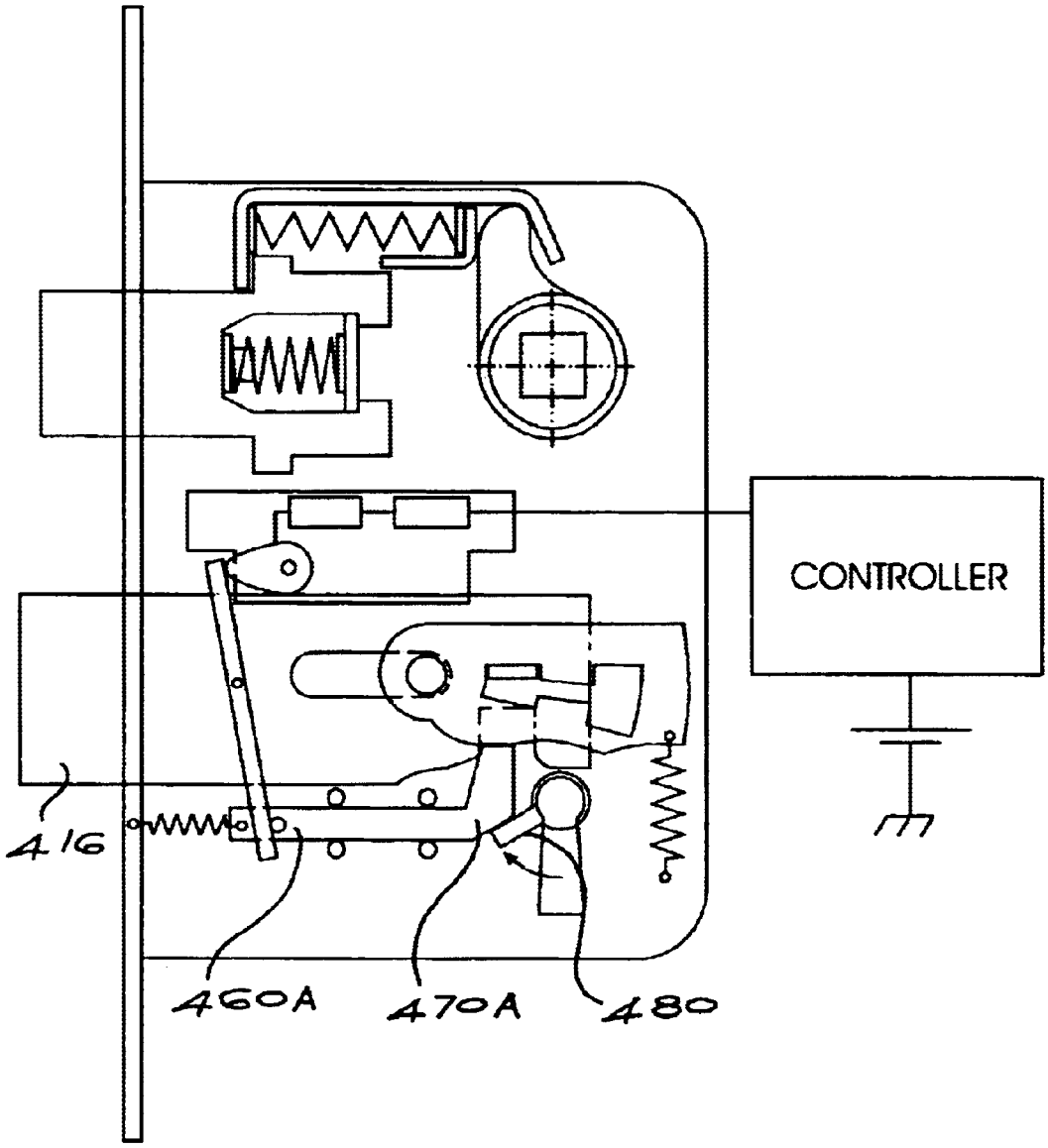
Figure 31:
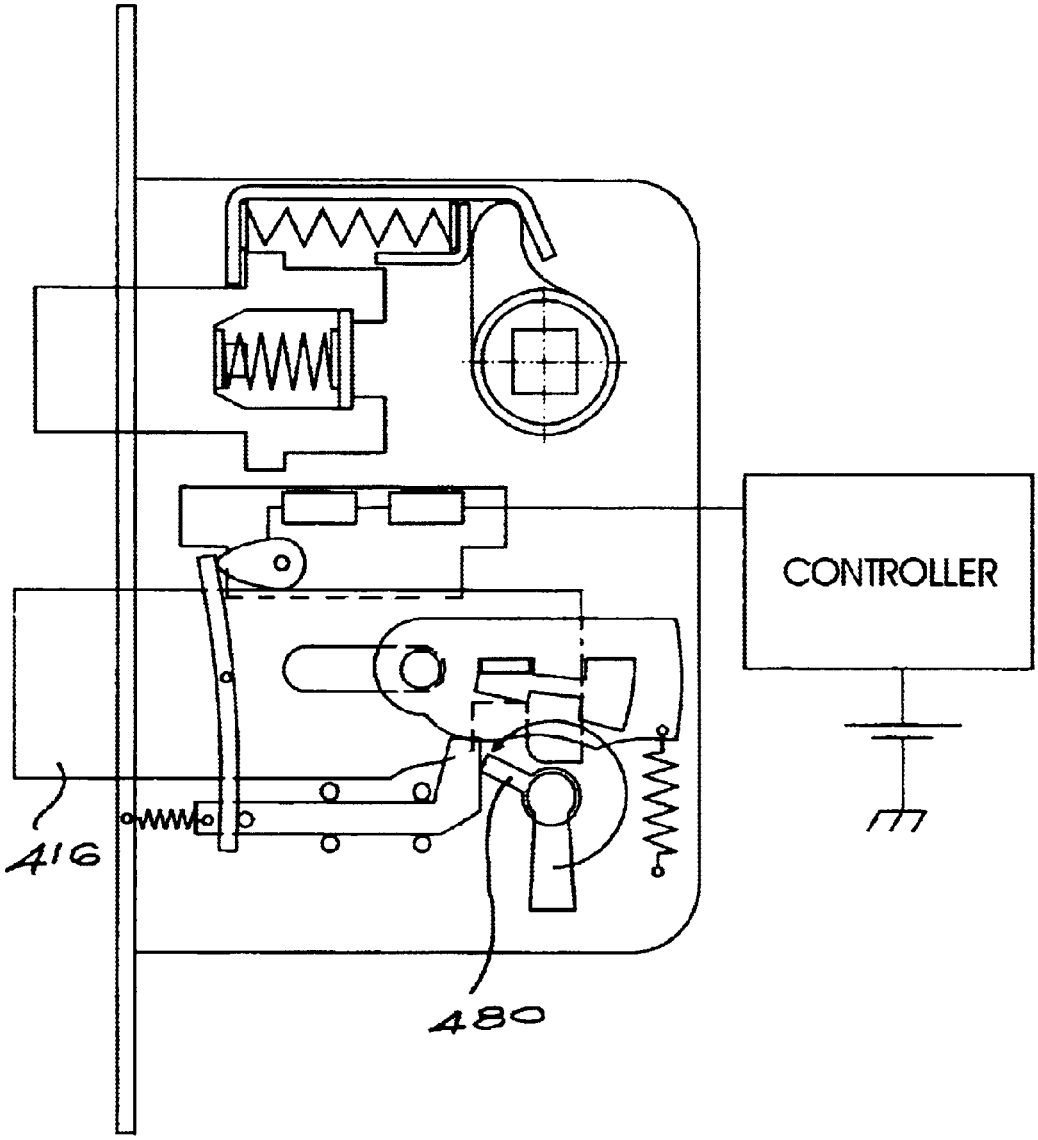

FIGS. 29, 30 and 31 show a lock 10A which is similar in many respects to what has been described in connection with FIGS. 27 and 28 and, where applicable, components of the lock 410A which are the same as corresponding components of the lock 410 bear like reference numerals.

In the arrangement shown in FIG. 27 the blocking member 460 is used to prevent a key from being inserted into the keyhole 442. By way of contrast in the arrangement shown in FIG. 29 blocking member 460A is movable in a manner which is analogous to what has been described in connection with FIG. 27, by means of a motor driven cam 450 which acts through a lever 454, not to block the keyhole 442 but to prevent movement of the levels 432 and to prevent rotation of the key 480, in one or more rotational direction FIG. 29 illustrates the lock 410A in a position at which a key 480 can be inserted into the keyhole 142 and can be freely rotated to cause movement of the levers 432.

If the blocking member is moved to the right, as is shown in FIG. 30 a formation 470A, at the right-hand end of the blocking member, is moved to a position at which rotation of the key 460 is inhibited. The formation 470A is moved to a position at which free rotation of the key is restrained and the key is thereby prevented from coming into contact with the levers 432. This is with rotation of the key in a clockwise direction.

By way of contrast, referring to FIG. 31, if the key 480 is rotated in a counter-clockwise direction then the key is able to operate on the levers 432. At a limiting point in its rotational movement, however, the key abuts the formation 470A and forces the blocking member 460A to the left. The lever 454 is placed under stress and can be bent. For this reason the ever should be made from a bendable material.

It follows that, referring to FIG. 30, when the bolt 416 is in a locked position and the cam is actuated to take up the position shown in FIG. 30, the bolt cannot be unlocked by means of a key. On the other hand if the bolt is in an unlocked position and the cam is in the FIG. 30 position (which is the same as in the FIG. 31 position) then the key 480 is capable of moving the bolt from an unlocked to a locked position.

Again it is to be noted that in the example shown in FIGS. 29, 30 and 31, the blocking member is used to disable locking of the bolt by means of a key. According to requirement the blocking member could be used to prevent key-actuated unlocking of the bolt.

Figure 32:
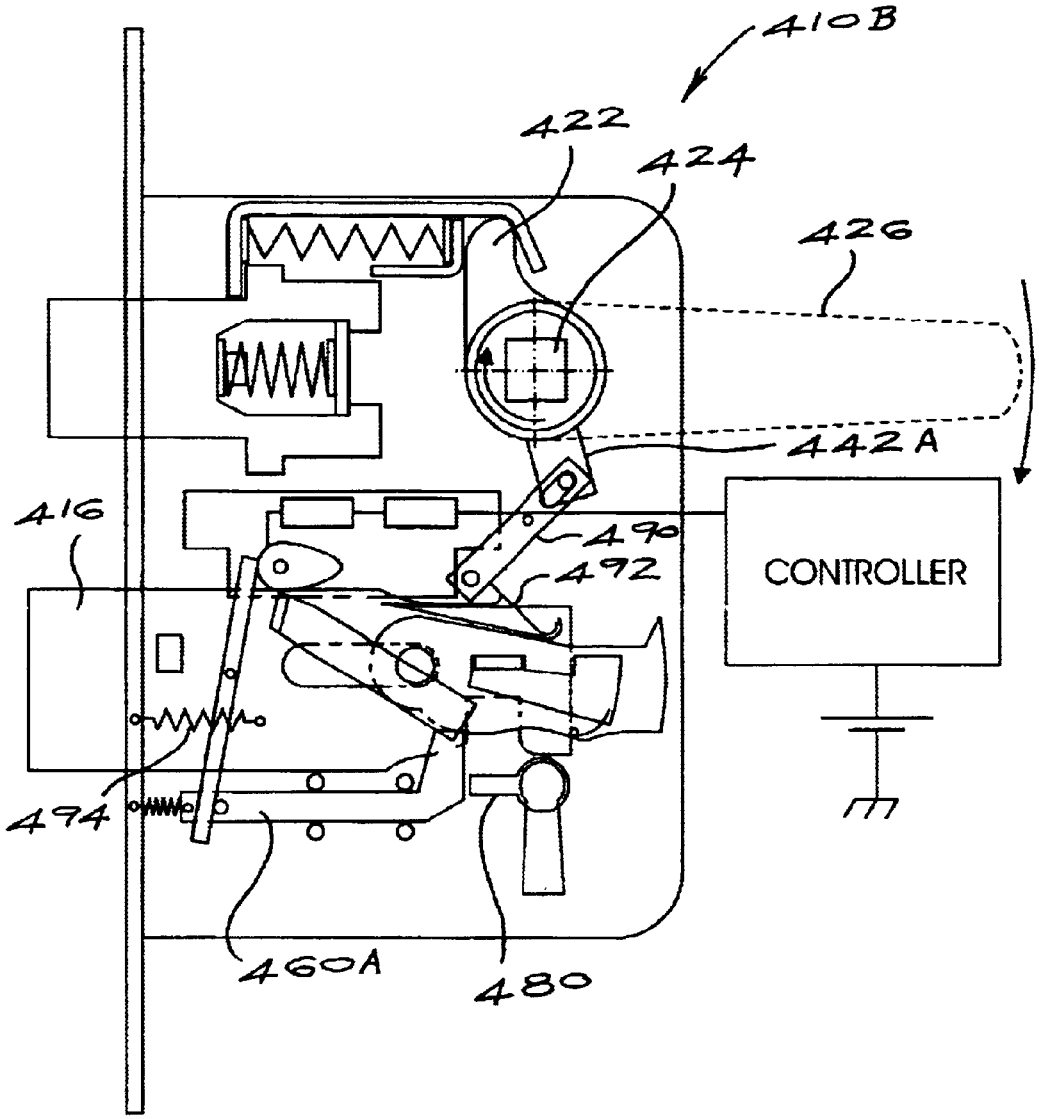
FIGS. 32, 33 and 34 illustrate a lock according to yet another form of the invention in different modes.
Figure 33:
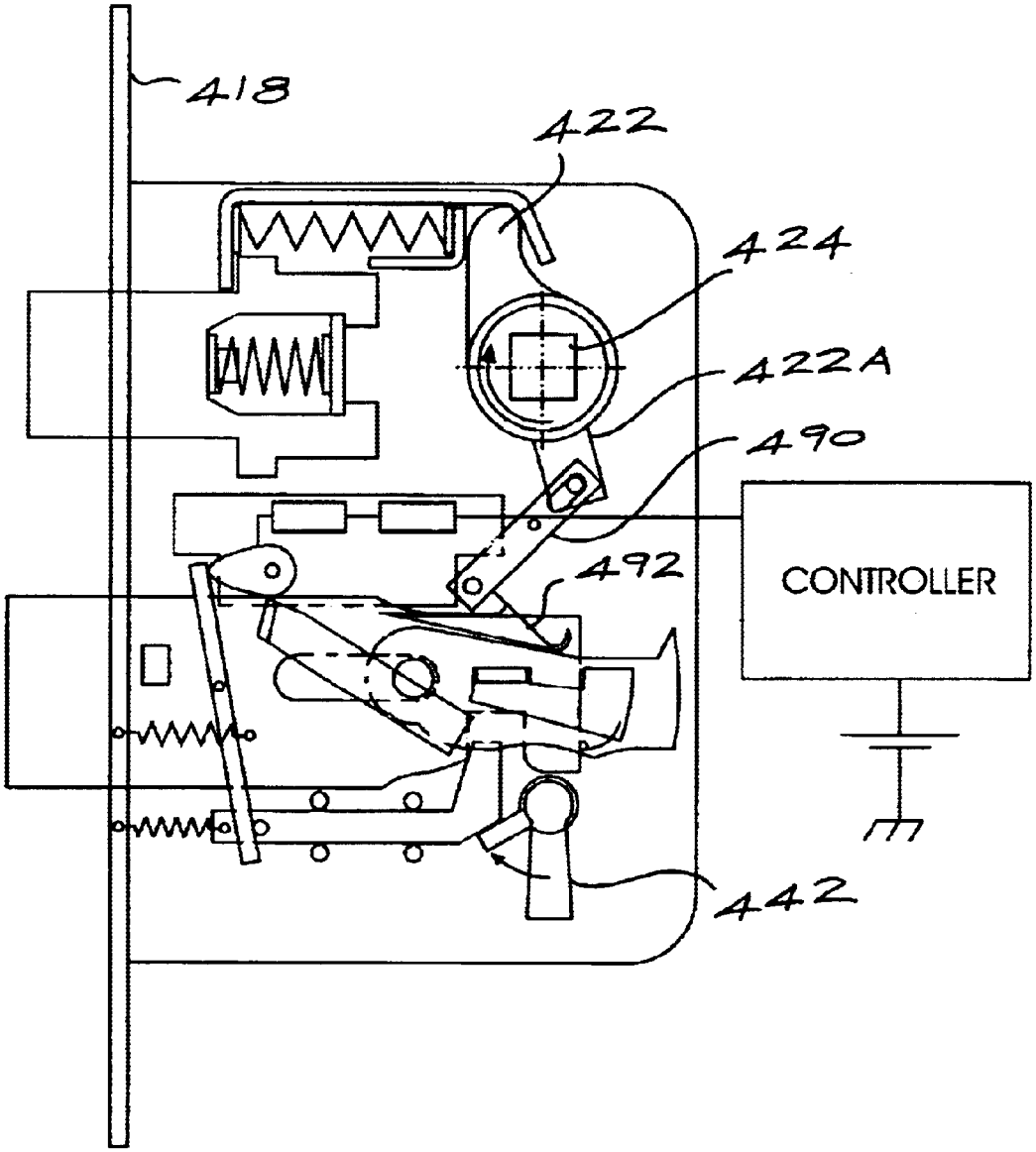
Figure 34:
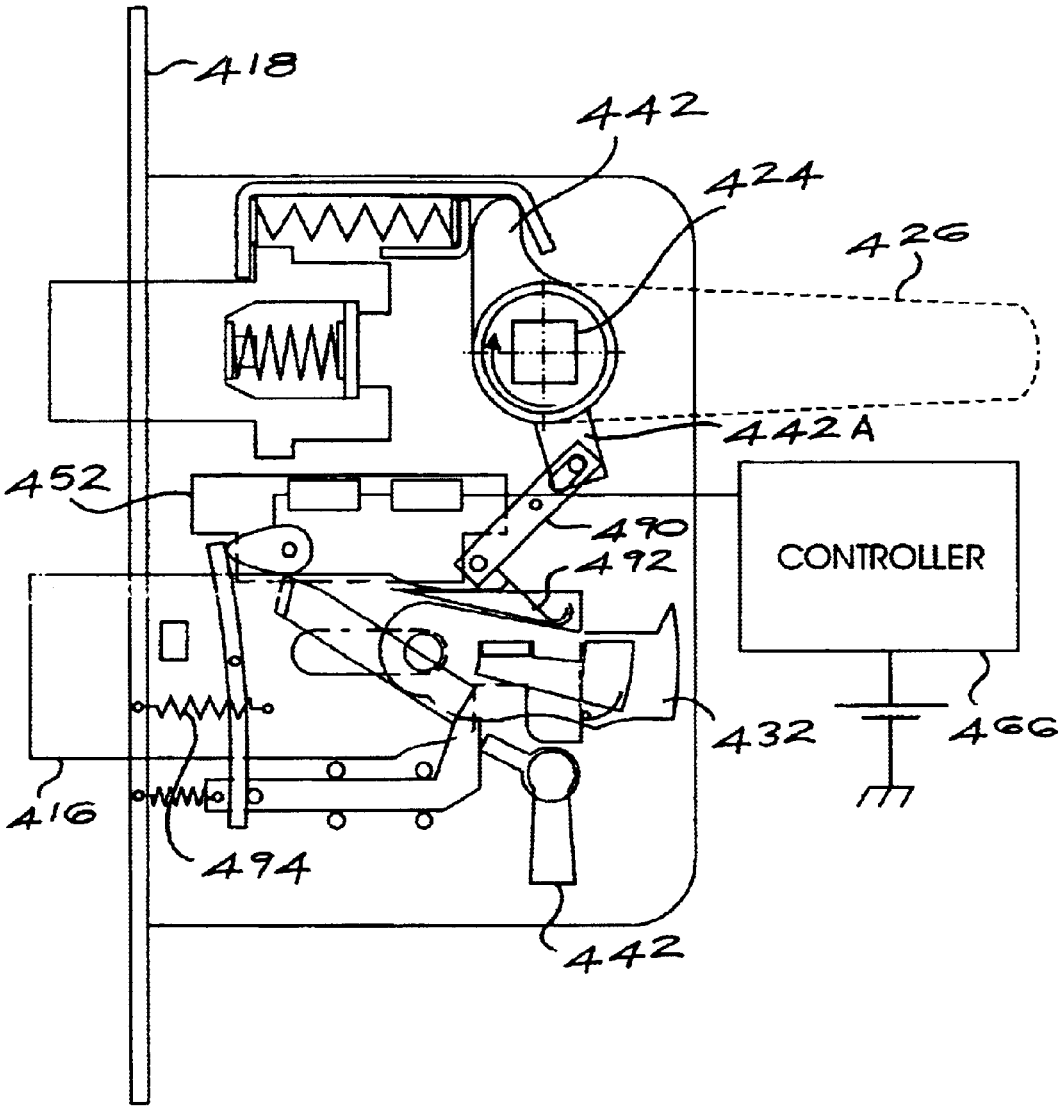

FIGS. 32, 33 and 34 illustrate a lock 410B which bears many resemblances to the lock shown in FIGS. 29, 30 and 31. Again like components are designated by means of like reference numerals. The lock 410B additionally however has certain of the functions and components described in the specification of international patent application No. PCT/ZA99/00116. Thus the handle-operated shaft 424 acts on a second lever 422A which in turn is connected to a pivotally mounted link 490. When the handle 426 is depressed the link 490 is moved into engagement with a hook-shaped catch 492 and the bolt 416 is moved to the right, ie. to an unlocked position, against the action of a spring 494. A secondary catch keeps the bolt in the retracted position. The bolt can be released by means of a correctly coded remotely generated signal which is received by the controller and which in turn causes operation of the cam 450. The stored energy in the spring 494 then moves the bolt from the unlocked to the locked position. This particular sequence of operations is not described in detail herein for it is similar to the sequence described in the specification of international application No. PCT/ZA99/00116.

It can be seen from a comparison between FIGS. 29, 30 and 31 on the one hand and FIGS. 32, 33 and 34 on the other hand that the blocking member 460A in the lock 410B functions in the same way as the blocking member 460A in the lock 410A. Thus with the blocking member 460A in the FIG. 32 position, the key 480 can be freely inserted into the keyhole 442 and rotated according to requirement to lock or to unlock the bolt. This is apart from the facility to control the locking of the bolt electronically using energy stored in the spring 494 as has been described in the specification of international patent application No PCT/ZA99/00116.

With the locking member 460A in the FIG. 33 position the key 480 cannot be rotated to unlock the bolt. On the other hand if the bolt is retracted, ie. in an unlocked position then, as is indicated from an examination of FIG. 34, rotation of the key in an anticlockwise direction will cause the levers 432 to be lifted and the bolt will be moved from an unlocked to a locked position under the action of the key and under the action of the spring 494. The key will however contact the formation 470A and urge the blocking member to the left thereby once again causing movement of the lever 454.

In FIGS. 32 to 34, the blocking member is used to prevent a key from being employed to unlock the bolt. In a different mode of operation the blocking member can be used to prevent the key from being employed to move the bolt from an unlocked to a locked position.

This aspect of the invention has been described with reference to three examples which are based on the use of a mortise type lock. As has been pointed out the scope of the invention is not limited in this regard for the principles thereof can be employed with cylinder type locks or other locks, and in particular with locks of the type shown in FIGS. 1 to 26.

What is claimed is:

1. A lock which includes a bolt (14), a catch (12) and a handle (16) for manually moving the catch from an operative position to an inoperative position, first link means (42), electrically actuable means (24, 26, 28) for causing movement of the first link means between first and second positions, the first link means, at the first position, translating movement of the handle (16) in a first direction into movement of the bolt (14) from a locked position to an unlocked position and, at the second position, allowing handle movement in the first direction without corresponding movement of the bolt and energy storage means (74) which is operable to release energy which at least assists in moving the bolt from the unlocked position to the locked position, and which is characterized in that the lock includes a catch mechanism (58) for retaining the bolt in the unlocked position and wherein the electrically actuable means is operable to release the catch mechanism to allow the bolt to be moved from the unlocked position to the locked position under the action of the energy storage means.

2. A lock according to claim 1 which is characterized in that it includes a bolt axle (20), a hold lever (70) which is rotatable about the axle, an unlock lever (72) which is fixed to, and which is rotatable in unison with, the axle, and at least one formation (78 to 86) on at least one of the hold lever and the unlock lever whereby rotation of the hold lever in a first direction causes rotation of the unlock lever in the first direction, rotation of the hold lever in a second direction which is opposite to the first direction does not cause corresponding rotation of the unlock lever in the second direction, rotation of the unlock lever in the second direction causes corresponding rotation of the hold lever in the second direction, and rotation of the unlock lever in the first direction does not cause corresponding rotation of the hold lever in the first direction, a component of the first link means (42) being connected to the hold lever (70) and a component of the catch mechanism (58) being connected to the unlock lever (72), whereby movement of the first link means component caused by movement of the hold lever in the second direction causes movement of the catch mechanism component from a retaining position to a non-retaining position.

3. A lock according to claim 2 is characterized in that the electrically actuable means (24, 26, 28) is operable to cause movement of the component of the catch mechanism (58) from the retaining position to the non-retaining position.

4. A lock according to claim 1 characterized in that the movement of the catch (12) from the operative position to the inoperative position is linear movement, the movement of the bolt from the locked position to the unlocked position is linear movement, and wherein the linear movement of the bolt is greater, at least initially, than the linear movement of the catch.

5. A lock according to claim 4 characterized in that the handle (216) is mounted to a catch axle (218) and the first link means (42) includes a catch lever (252) which is mounted for rotation to the catch axle (218), a bolt lever (224) which is mounted for rotation to the bolt axle (220), and a link (254) which extends between a pivot point (256) on the catch lever and a pivot point on the bolt lever (224), and wherein the distance between the pivot point on the catch lever and the catch axle is greater than the distance between the pivot point on the bolt lever and the bolt axle.

6. A lock according to claim 5 characterized in that the movement of the catch from the operative position to the inoperative position is slower, at least initially, than the movement of the bolt from the locked position to the unlocked position.

7. A lock according to claim 6 characterized in that the slower movement of the catch is achieved by at least one of the following:

(a) adjusting the length of the bolt lever relatively to the length of the catch lever, and (b) adjusting the angle of the bolt lever relatively to the angle of the catch lever, at the start of the movement of the bolt from the locked position to the unlocked position.

8. A lock according to claim 1 characterized in that the electrically actuable means includes a motor (28) which causes movement of a cam (24) via a gearbox (26).

9. A lock according to claim 8 characterized in that the cam (24) acts on the catch mechanism (58).

10. A lock according to claim 1 characterized in that the electrically actuable means is remotely operable.

11. A lock according to claim 1 characterized in that it includes a bolt axle (220), a bolt lever (224), a formation (228), a spring (238) with a hook formation (236) which bears against the formation (228), and a catch formation (244) with which the hook formation (236) is engageable, and in that, when the bolt lever (224) is rotated in a first direction, the hook formation (236) remains in engagement with the catch formation (244) and the spring yields, and when the bolt lever (224) is rotated in a second direction which is opposite to the first direction, the formation (228) causes the hook formation (236) to disengage from the catch formation (244), to allow further rotation of the bolt lever.

* * * * *